US009114292B2

(12) United States Patent
Clausen et al.

(10) Patent No.: US 9,114,292 B2
(45) Date of Patent: Aug. 25, 2015

(54) GOLF CLUB HEAD WITH STABLIZING SOLE

(75) Inventors: Karl A. Clausen, Carlsbad, CA (US); Thomas W. Preece, Carlsbad, CA (US); Douglas E. Roberts, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 305 days.

(21) Appl. No.: 13/407,011

(22) Filed: Feb. 28, 2012

(65) Prior Publication Data

US 2013/0225317 A1 Aug. 29, 2013

(51) Int. Cl.

| | |
|---|---|
| ***A63B 53/00*** | (2006.01) |
| ***A63B 53/04*** | (2015.01) |
| ***A63B 49/06*** | (2006.01) |

(52) U.S. Cl.

CPC ..... *A63B 53/0466* (2013.01); *A63B 49/06* (2013.01); *A63B 53/047* (2013.01); *A63B 2053/045* (2013.01); *A63B 2053/0408* (2013.01); *A63B 2053/0433* (2013.01); *A63B 2053/0462* (2013.01); *A63B 2225/01* (2013.01)

(58) Field of Classification Search

USPC ..... 473/345, 344, 328

See application file for complete search history.

(56) References Cited

U.S. PATENT DOCUMENTS

| | | | | | |
|---|---|---|---|---|---|
| 2,004,968 | A | * | 6/1935 | Young | 473/343 |
| 2,014,829 | A | * | 9/1935 | Young | 473/344 |
| 2,301,369 | A | * | 11/1942 | Carvill | 473/344 |
| 2,593,368 | A | | 4/1952 | Verderber | |
| 3,589,731 | A | | 6/1971 | Chancellor, Jr. | |
| 3,625,518 | A | * | 12/1971 | Solheim | 473/330 |
| 3,815,921 | A | * | 6/1974 | Turner | 473/328 |
| 4,139,196 | A | | 2/1979 | Riley | |
| 4,498,673 | A | * | 2/1985 | Swanson | 473/328 |
| 4,671,513 | A | * | 6/1987 | Swanson | 473/328 |
| 4,735,414 | A | | 4/1988 | Williams | |
| 4,756,534 | A | * | 7/1988 | Thompson | 473/328 |
| 4,804,184 | A | * | 2/1989 | Maltby | 473/409 |
| 5,213,329 | A | * | 5/1993 | Okumoto et al. | 473/328 |
| 5,326,105 | A | | 7/1994 | Fenton, Jr. | |
| 5,573,469 | A | * | 11/1996 | Dekura | 473/314 |
| 5,632,695 | A | | 5/1997 | Hlinka et al. | |
| 5,779,565 | A | * | 7/1998 | Adams | 473/328 |
| 5,800,281 | A | | 9/1998 | Gilbert | |
| 5,931,745 | A | * | 8/1999 | Adams | 473/328 |
| 6,093,113 | A | | 7/2000 | Mertens | |
| 6,251,028 | B1 | * | 6/2001 | Jackson | 473/305 |
| 6,447,405 | B1 | * | 9/2002 | Chen | 473/328 |
| 6,471,601 | B1 | | 10/2002 | McCabe et al. | |
| 6,569,029 | B1 | | 5/2003 | Hamburger | |

(Continued)

FOREIGN PATENT DOCUMENTS

JP 2005168998 A 6/2005

OTHER PUBLICATIONS

Kato, JP 2005-168998A, Apr. 22, 2014, Machine Translation, 10 pages.*

*Primary Examiner* — Gene Kim
*Assistant Examiner* — Matthew B Stanczak
(74) *Attorney, Agent, or Firm* — Brown Rudnick LLP

(57) ABSTRACT

The invention generally provides a golf club head having a sole with a region for surface contact such that, when an adjustable club is given different settings, if the club is held at address resting on a surface, the club naturally comes to a rest position in which it exhibits substantially the same face angle in any adjusted setting.

7 Claims, 22 Drawing Sheets

(56) References Cited

U.S. PATENT DOCUMENTS

| | | | | |
|---|---|---|---|---|
| 6,860,818 | B2 | 3/2005 | Mahaffey | |
| 7,396,296 | B2 * | 7/2008 | Evans | 473/344 |
| 7,648,426 | B2 * | 1/2010 | Evans | 473/345 |
| 7,699,717 | B2 | 4/2010 | Morris et al. | |
| 7,704,155 | B2 * | 4/2010 | Bennett et al. | 473/245 |
| 7,803,065 | B2 | 9/2010 | Breier et al. | |
| 7,837,577 | B2 * | 11/2010 | Evans | 473/345 |
| 7,878,921 | B2 | 2/2011 | Bennett | |
| 7,934,999 | B2 * | 5/2011 | Cackett et al. | 473/242 |
| 7,967,695 | B2 | 6/2011 | Voges | |
| 8,012,034 | B1 * | 9/2011 | Cackett et al. | 473/242 |
| 8,226,501 | B2 * | 7/2012 | Stites et al. | 473/349 |
| 8,303,429 | B2 | 11/2012 | Cackett et al. | |
| 8,430,764 | B2 * | 4/2013 | Bennett et al. | 473/324 |
| 8,496,543 | B2 * | 7/2013 | Cackett et al. | 473/344 |
| 8,517,851 | B2 * | 8/2013 | Cackett et al. | 473/242 |
| 2003/0104876 | A1 | 6/2003 | Sosin | |
| 2006/0094527 | A1 * | 5/2006 | Evans | 473/328 |
| 2007/0149310 | A1 * | 6/2007 | Bennett et al. | 473/328 |
| 2007/0149315 | A1 * | 6/2007 | Bennett et al. | 473/334 |
| 2008/0020861 | A1 | 1/2008 | Adams et al. | |
| 2008/0125239 | A1 | 5/2008 | Clausen et al. | |
| 2008/0227564 | A1 | 9/2008 | Breier et al. | |
| 2008/0254909 | A1 | 10/2008 | Callinan et al. | |
| 2009/0088275 | A1 | 4/2009 | Solheim et al. | |
| 2009/0124410 | A1 | 5/2009 | Rife | |
| 2009/0197694 | A1 | 8/2009 | Soracco et al. | |
| 2009/0215551 | A1 | 8/2009 | Liang et al. | |
| 2009/0247316 | A1 | 10/2009 | De La Cruz et al. | |
| 2009/0264214 | A1 | 10/2009 | De La Cruz et al. | |
| 2009/0326688 | A1 | 12/2009 | Thomas et al. | |
| 2010/0056297 | A1 | 3/2010 | Roach et al. | |
| 2010/0105499 | A1 | 4/2010 | Roach et al. | |
| 2010/0261543 | A1 | 10/2010 | Breier et al. | |
| 2010/0292018 | A1 * | 11/2010 | Cackett et al. | 473/246 |
| 2010/0298065 | A1 | 11/2010 | Soracco et al. | |
| 2010/0323811 | A1 | 12/2010 | Mickelson et al. | |
| 2011/0039637 | A1 * | 2/2011 | Cackett et al. | 473/345 |
| 2011/0053702 | A1 * | 3/2011 | Stites et al. | 473/291 |
| 2011/0053703 | A1 * | 3/2011 | Stites et al. | 473/291 |
| 2011/0143854 | A1 | 6/2011 | Bennett et al. | |
| 2011/0151989 | A1 | 6/2011 | Golden et al. | |
| 2011/0152003 | A1 | 6/2011 | Hartwell et al. | |
| 2011/0190070 | A1 | 8/2011 | Morris et al. | |
| 2011/0275455 | A1 | 11/2011 | Soracco | |
| 2011/0277313 | A1 | 11/2011 | Soracco et al. | |
| 2011/0312436 | A1 * | 12/2011 | Cackett et al. | 473/307 |
| 2012/0122603 | A1 * | 5/2012 | Cackett et al. | 473/307 |
| 2012/0202610 | A1 | 8/2012 | Voges et al. | |
| 2013/0012334 | A1 * | 1/2013 | Stites et al. | 473/345 |
| 2013/0029783 | A1 * | 1/2013 | Kimizuka et al. | 473/345 |

* cited by examiner

GOLF CLUB HEAD WITH STABLIZING SOLE

FIELD OF THE INVENTION

The invention generally relates to golf club heads to optimize performance of adjustable golf clubs.

BACKGROUND

Golfers make their best shots when provided with golf clubs that fit their playing style. A golfer may want a driver with a particular loft or face angle. For example, a closed face angle may help a golfer who consistently slices to the right. Another golfer with high speed, high accuracy drives may want a driver with a low loft for maximum distance.

Manufacturers offer adjustable clubs, such as drivers, fairways, and hybrids, with multiple settings for face angle, loft, or both. However, there can be problematic interrelationships between different settings.

For example, in some clubs, if loft is increased, then when the club is held at address resting on a surface, the club tends to exhibit a closed face angle. If the loft is decreased and the club is held at address resting on a surface, that club will then exhibit an open face angle. A golfer's shot may be influenced by how the club rests at address. Thus, adjusting a setting on an adjustable club can cause the club to launch the ball in unexpected ways, resulting in unpredictable and inaccurate shots.

SUMMARY

The invention provides a golf club head with a contoured sole that minimizes unintended changes when held at address in different positions or when loft or face angle is adjusted. The invention mitigates the change in relationship between the club balance point and ground contact point at address, that most often manifests as a rotation to a "rest position" when adjustments are made to the club head. The invention provides a lowest region of the sole to contact the ground in any effective club setting. For a club having a contoured sole region according to the invention, the spatial relationship between contact point and balance point is substantially the same in different settings. Thus a club head of the invention does not exhibit a problematic interrelationship between different address positions or adjustable loft and face angle settings.

In certain aspects, the invention provides a golf club head with a stabilizing element protruding from the sole by a height H, having a maximum length L, a maximum width W, and a setback S from a front-most point on the club face when a golf club including the club head is held at address. In some embodiments, S is more than about 1 cm, L is more than about 1 cm, W is more than about 1 mm, and H is more than about 0.1 mm. For example, S can be between about 2.5 cm and about 3.5 cm; L between about 2.5 cm and about 12 cm; W between about 3 mm and about 20 mm; and H between about 0.3 mm and about 2 mm.

The height H can be defined as, when a golf club including the club head is held at address resting on flat ground, the average distance from the ground of the points on perimeter of the stabilizing element directly fore and aft of the contact point.

In some embodiments, the sole is configured such that, when a golf club including the club head is held at address in either of a first or second position, the club head makes contact with a surface only within the stabilizing element. In some embodiments, the sole is configured such that, when a golf club including the club head is held at address in either of a first or second configuration such that a face of the club head has a first or second loft setting, respectively, the club head makes contact with a surface only within the stabilizing element. For example, the first loft can be between about 6° and about 9.5° and the second loft can be between about 11° and about 14.5°. In either configuration, a balance point of the club causes the club to exhibit a neutral face angle.

In certain aspects, the invention provides a golf club head having a face, a crown, a skirt, and a sole, wherein a club including the club head can be held at address in two different positions and the sole is contoured such that, when the club is at address resting on a surface, it exhibits substantially the same face angle and loft in each position. In certain embodiments, the club head is adjustable and can be set to two or more loft settings and the sole is contoured such that, when the club is at address resting on a surface, it exhibits substantially the same face angle in each loft setting. Further, in each loft setting, the club head makes contact with the ground within a lowest region of the sole having a limited area. At least two of the two or more loft settings can be up to six degrees from each other, and the corresponding face angles at address will be substantially the same (e.g., open, neutral, or closed).

For example, the club can have a first loft between about 8° and about 9.5° and a second loft is between about 10° and about 12.5°. A contact point when the club is in the first loft setting and the corresponding second contact point are within about 15 mm from each other in a face-aft direction (e.g., less than about 10 mm apart). Further, the first contact point and the second contact point are on the downward-most region of the sole. The region can have a surface area between about 0.1 $cm^2$ and about 40 $cm^2$ (e.g., between about 0.5 $cm^2$ and about 20 $cm^2$).

Looking at the sole in plan view, the region of the sole bounding the contact points can be described with reference to a width W measured in the face-aft direction, a length L measured in the heel-toe direction, and a setback S from the front-most point on the club. In certain embodiments, the region including the contact points can be described in terms of a height H such that when the club is at address with any loft setting, every point on the sole outside of the region is more than a distance H above the ground. In some embodiments, W is between about 1 mm and about 20 mm, L is between about 2 cm and about 20 cm, S is between about 1 cm and about 5 cm, and H is between about 0.01 mm and about 5 mm.

The region bounding the contact points can be disposed centered on a center line of the club or biased in a heel-toe direction. In some embodiments, more than about 70% of the stabilizing element is located on a heel side of the sole.

In certain aspects, the invention provides a golf club head with a face, a sole, a crown, and a hosel, such that if the club head is coupled to a shaft to form a golf club and held at address resting on a surface, the sole makes contact with the ground between a first heel-toe line a distance S from the front of the club and a second such line a distance (S+W) from the front of the club. An idealized front plane tangent to the sole intersects the ground along the first line, defining an angle of X degrees with the ground and an idealized back plane tangent to the sole intersects the ground along the second line, defining an angle of Y degrees with the ground.

In certain embodiments, S is between about 10 mm and about 50 mm, W is between about 1 mm and about 25 mm, and X+Y is between about 0.01° and about 40°.

The club head can be adjusted to a first loft setting (e.g., between about 6° and about 9.5°) and a second loft setting (e.g., between about 11° and about 14.5°). In either loft setting, the club balances with a neutral or other pre-set face angle. Further, X+Y can be between about 1° and about 10°, or between about 2.5° and about 8°. In some embodiments S is between about 1 mm and about 5 cm (e.g., between about 1.5 mm and about 4 cm), and W is between about 6 mm and about 20 mm.

In certain aspects, the invention provides a golf club head with a face, a sole, a crown, and a hosel, in which the sole has a region protruding downward from the surrounding sole area, the region having a length L in the heel-toe direction, a width W in the face-aft direction, and a height H in the vertical direction when the club is at address. The region may be set back from the foremost point on the face by a distance S. The height H can defined as the average height from the ground to all portions of an area of the sole surrounding the region. The surrounding sole area can be defined to include a fore sole and aft sole or about 1 cm fore and aft of the region. In some embodiments, S is more than about 1 cm, L is more than about 1 cm, W is more than about 1 mm, and H is more than about 0.1 mm.

A club head of the invention can be used to provide an adjustable club with a first loft between about 5° and about 9.5° and a second loft between about 10° and about 14.5° (e.g., a first loft between about 7° and about 9.0° and a second loft between about 11° and about 13°), and in either setting, when held at address resting on flat ground, the club naturally rocks to a preset face angle that is substantially the same (e.g., open, neutral, or closed) in both loft settings.

In some embodiments, S is between about 1 mm and about 5 cm or W is between about 6 mm and about 15 mm (as used herein, "or" always means "and/or" unless otherwise specified or indicated). In certain embodiments, S can between about 2.0 cm and about 3.5 cm; L can be between about 2.5 cm and about 12 cm; W can be between about 3 mm and about 20 mm; and H can between about 0.3 mm and about 2 mm.

The invention includes any combination of measurements, ways of measuring a factor, and embodiments disclosed herein. Thus, any description of a sole of a club herein, such as a metal wood, a fairway wood, an iron, or a hybrid, can be combined with any definition of L, W, H, S, or E along with any numerical value, range, or any value within a range for L, W, H, S, or E to describe a club head provided by the invention.

In certain aspects, the invention provides methods for fitting a club to a player including determining a salutary loft setting, a salutary face angle setting, or both, and providing a club with a setting according to the determination. The providing can be repeated for a plurality of different players using an inventory in which each club head has the same shape. The club heads of the inventory include a sole with a region shaped according to the description herein.

In certain aspects, the invention provides methods for distributing golf clubs including offering a club head capable of providing clubs with a plurality of effective loft settings, face angle settings, or both. Clubs can be provided according to the methods having a shape of a club head in common. Distribution methods include assigning a stock-keeping unit (SKU) to the club head such that a single SKU corresponds to clubs with different settings. Additional SKUs can be assigned to additional club heads having a similar shape. The additional club heads can be offered in a variety of colors or trim levels.

DETAILED DESCRIPTION

The invention generally relates to a feature on the sole of a club head that protrudes and stabilizes the club head in two or more positions when a club is at address.

Figure 1:
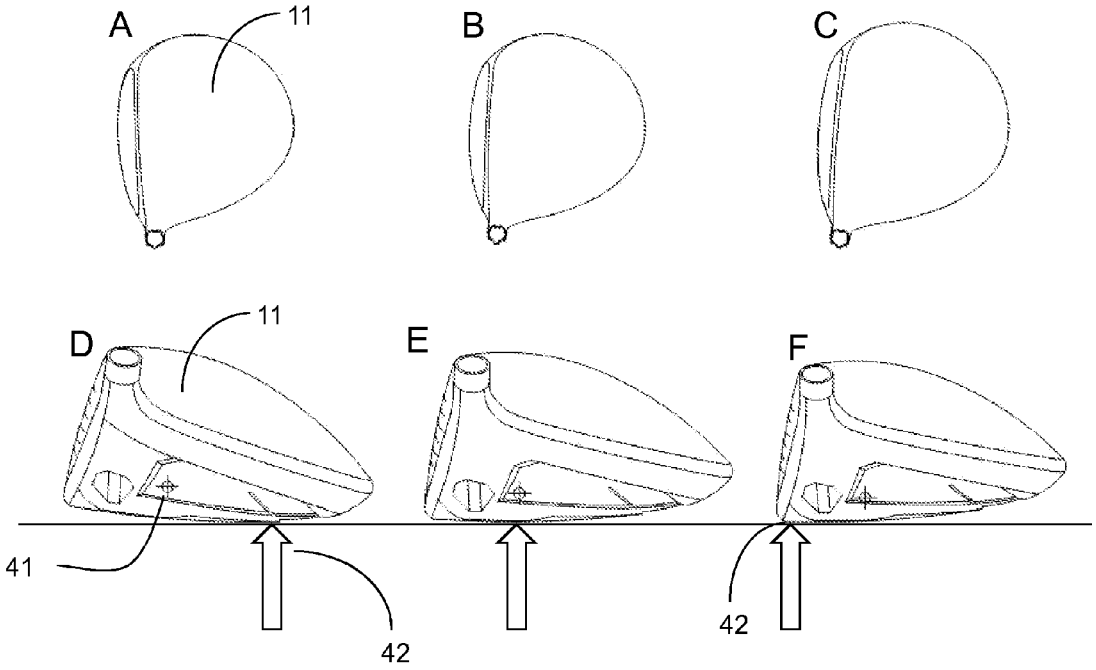
FIG. 1 PRIOR ART
FIG. 1 shows a prior art golf club head.

FIG. 1, panels D-F, show a prior art club head 11 positioned to produce different loft angles. In particular, panels D and A show prior art club head 11 having an 11.5° loft angle; panels E and B show prior art club head 11 having a 10° loft angle; and panels F and C show prior art club head 11 having an 8.5° loft angle. The invention mitigates the positional change of the sole relative to a club balance point 41 in different loft angles when club head 11 has different face angles (e.g., closed in panel A, neutral in panel B, and open in panel C).

Figure 2:
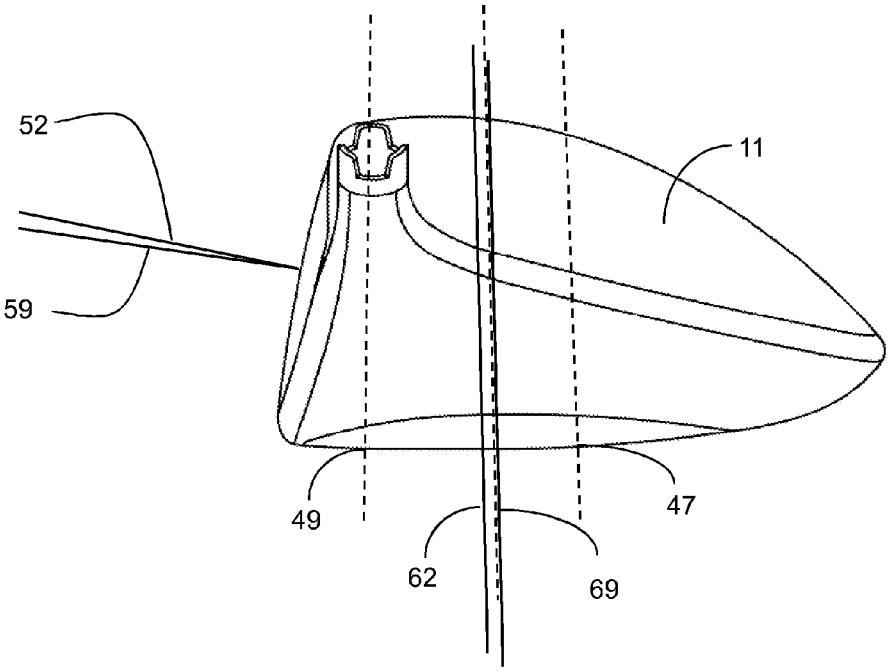
FIG. 2 PRIOR ART
FIG. 2 shows a prior art golf club head.

FIG. 2 shows prior art golf club head 11. FIG. 2 includes high loft indicator 52 and low loft indicator 59 as well as high loft contact indicator 47 and low loft contact indicator 49. FIG. 2 further shows high loft balance line 62 and low loft balance line 69 of prior art club head 11. As shown in FIG. 2, if prior art club head 11 is set with a high loft setting, it has a balance line 62 substantially fore (e.g., between about 1 and about 5 cm) of corresponding contact point 47. If prior art club head 11 is set with a low loft setting, it has a balance line 69 substantially aft of that corresponding contact point 49.

Figure 3:
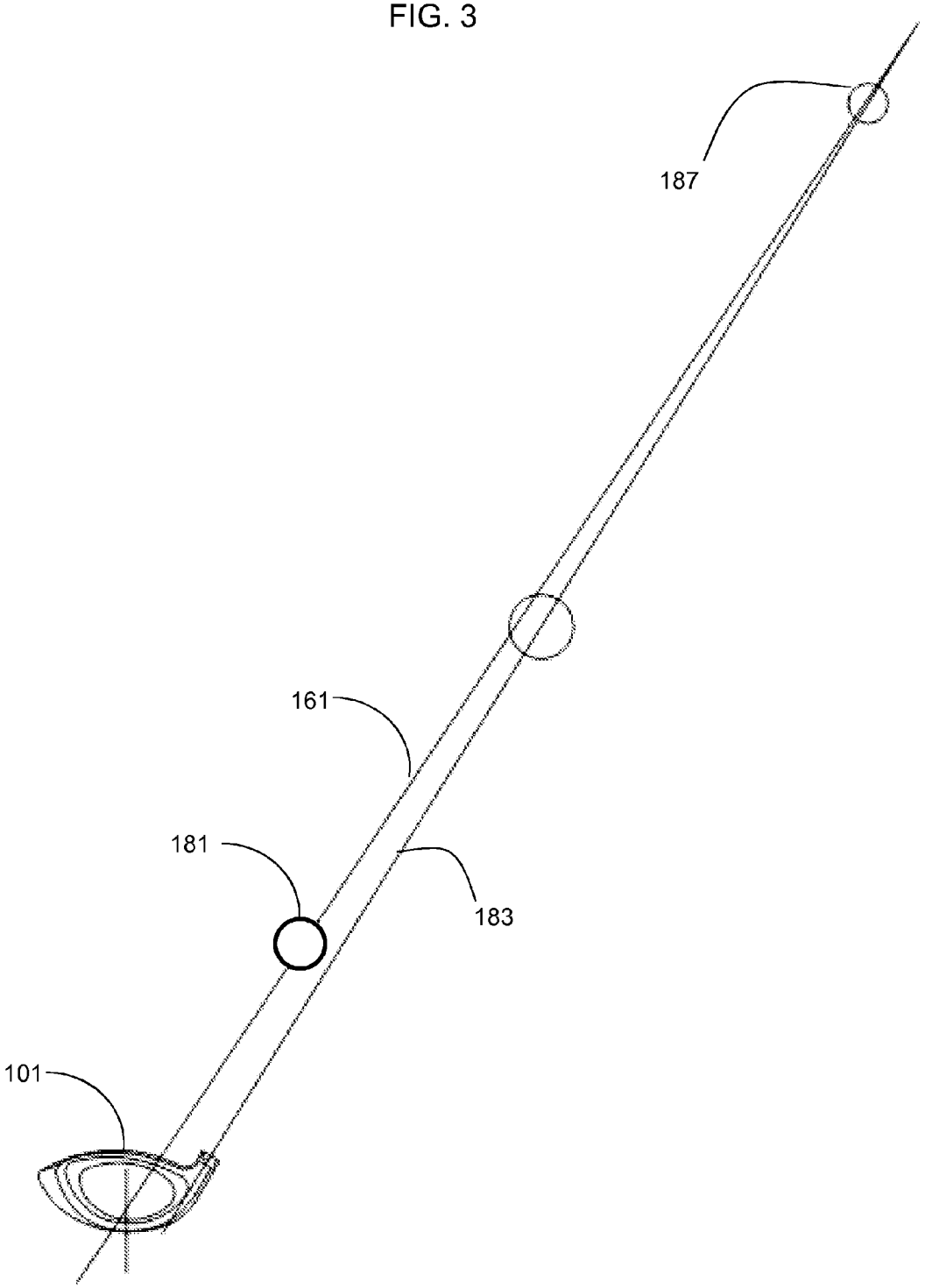
FIG. 3 is a front view of a golf club according to certain embodiments of the invention.

FIG. 3 is a front view of a golf club head at address according to certain embodiments of the invention showing balance line 161 passing through grip point 187 and club center of gravity 181. Shaft axis 183 passes through the center of a hosel of club head 101.

When a club is at address resting on a surface, grip point 187 and contact point 42 together define an axis around which motion of the golf club is relatively unrestrained. If balance line 161 intersects the sole behind the contact point, the club will rock open. If balance line 161 intersects the sole in front of the contact point, the club will rock closed.

Thus, the invention provides club head 101 having a sole with a contour or feature such that, if the club is held at address in a variety of orientations, then the contact point is within a controlled, limited distance from the point at which the balance line intersects the sole. Accordingly, the club can be held at address, yet in two different orientations at different times. For example, a first address position can be offset from a second address position by a slight tilt (e.g., either in a heel-toe direction, a fore-aft direction, or a combination thereof) and the contact point will be within the contour or feature in each address positions. In some embodiments, the sole is configured such that, when a golf club including the club head is held at address in either of a first or second position, the club head makes contact with a surface only within a stabilizing element as described herein.

Thus the invention allows a club to be held in different address positions (e.g., as a player learns or experiments, due to ground inconsistencies, as one club is used by players of different height) and obtain a consistent, predictable club head orientation. Due to the fact that the club head makes contact with the ground within a controlled region below the club balance point, the club will not "rock" into unintended orientations when held at address resting on a surface.

In certain embodiments, the invention provides club head 101 having a sole with a contour or feature such that, if the club head is set in a variety of loft settings, then the contact point is within a controlled, limited distance from the point at which the balance line intersects the sole. Club head 101 can have an adjustable loft capable of being set in at least a first and second position. With the loft set in either of the first or second position, the club head can rest on the feature in one of at least a first and second disposition allowing a player to grip the club with a comfortable, relaxed grip in each position and with the face angle maintained constant between each position.

The invention allows a player to adjust a loft setting, hold the club at address resting on a surface, and obtain a consistent, predictable face angle. This benefit gives a player a reliable reference point when setting up a shot in that the player can rest the club head on a surface and see the loft setting and the face angle (while the player holds the club with a comfortable, relaxed grip). The player can then grip the club and pick it up to make a shot, thereby obtaining the same relative face angle for every shot.

Figure 4:
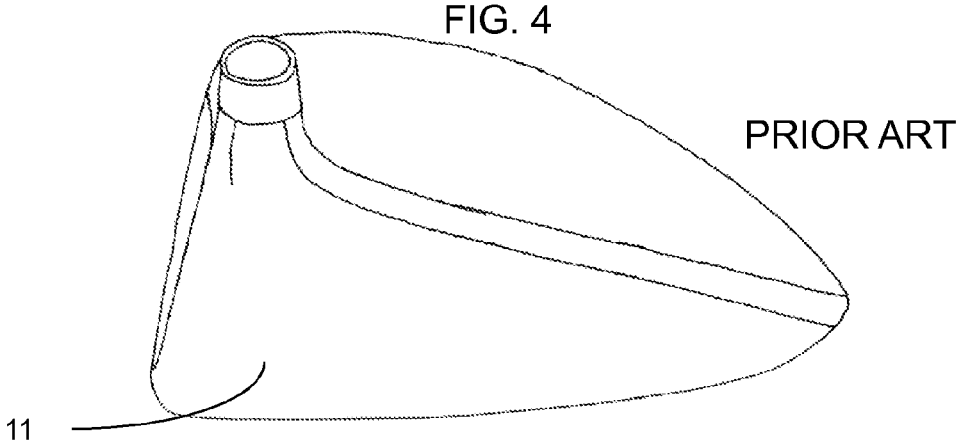
FIG. 4 shows a prior art golf club head.
Figure 5:
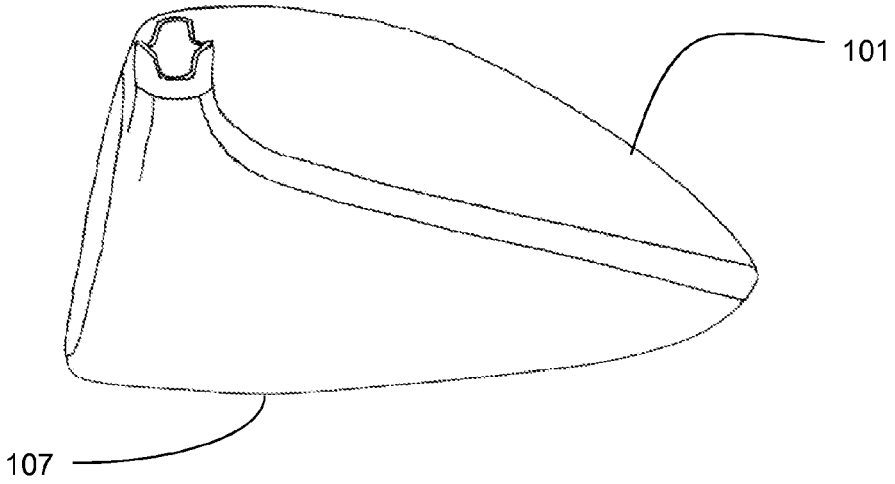
FIG. 5 is a side view of a golf club head according to certain embodiments of the invention.
Figure 6:
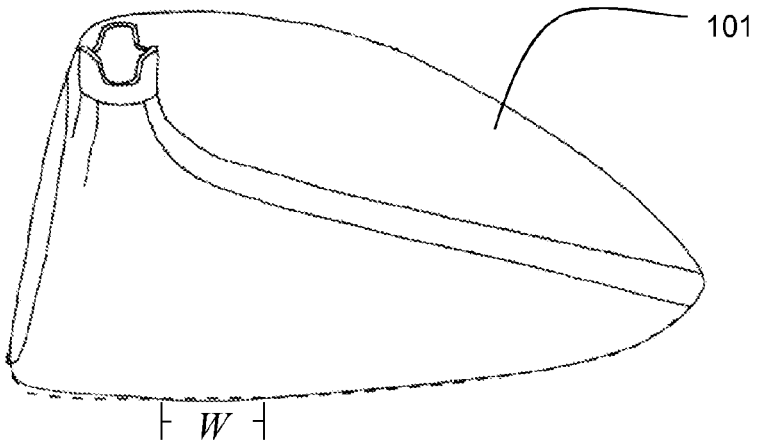
FIG. 6 shows the view of FIG. 5 with a prior art sole superimposed (dashed line).
Figure 7:
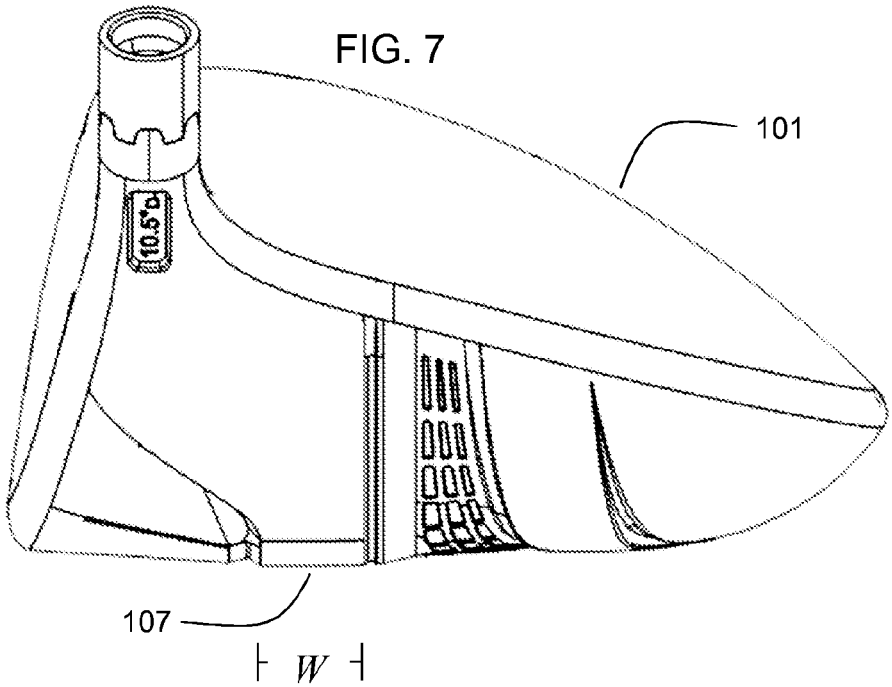
FIG. 7 is a side view of a golf club head according to certain embodiments of the invention.
Figure 8:
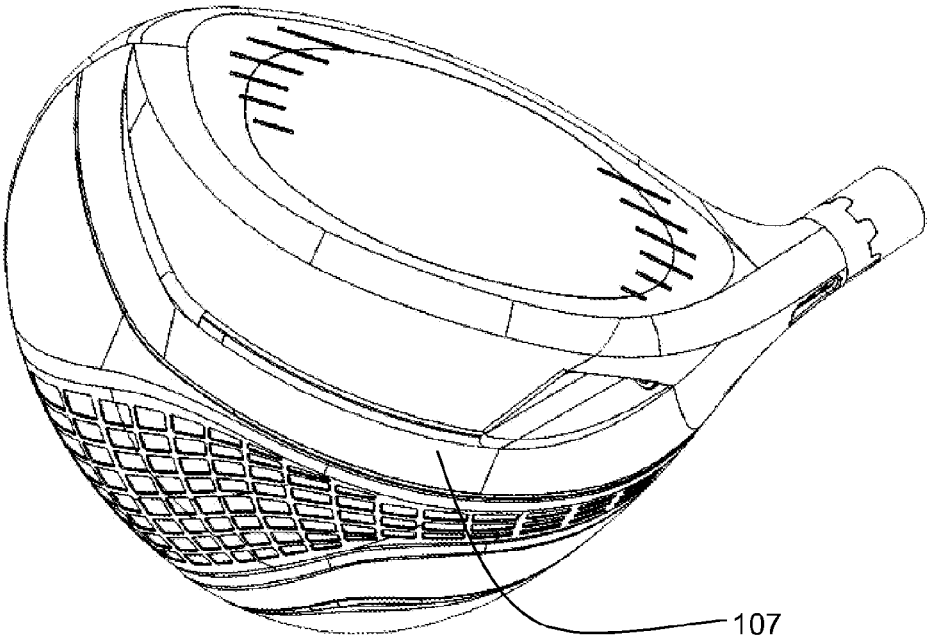
FIG. 8 is a bottom perspective view of a golf club head according to certain embodiments of the invention.
Figure 9:
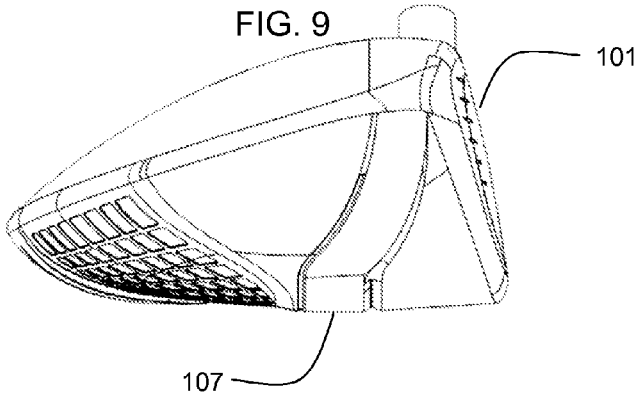
FIG. 9 is a side view of a golf club head according to certain embodiments of the invention.

FIG. 4 shows a prior art golf club head and FIG. 5 is a side view of a golf club head according to certain embodiments of the invention. FIG. 6 shows the view of FIG. 5 with a prior art sole superimposed (dashed line). As shown in FIG. 5, a golf club according to the invention generally has an area of relief on the sole providing a lower-most region 107 of the sole such that, if the club head is set in any of a range of loft angle settings, the contact point will be within region 107, and the region has a limited width W in the fore-aft direction. In general, the width W of the region in the fore-aft direction will be less than about 50 mm, for example, less than about 25 mm. In some embodiments, the contact points associated with various loft settings will be within less than about 20 or about 15 mm of each other in a fore-aft direction.

Figure 10:
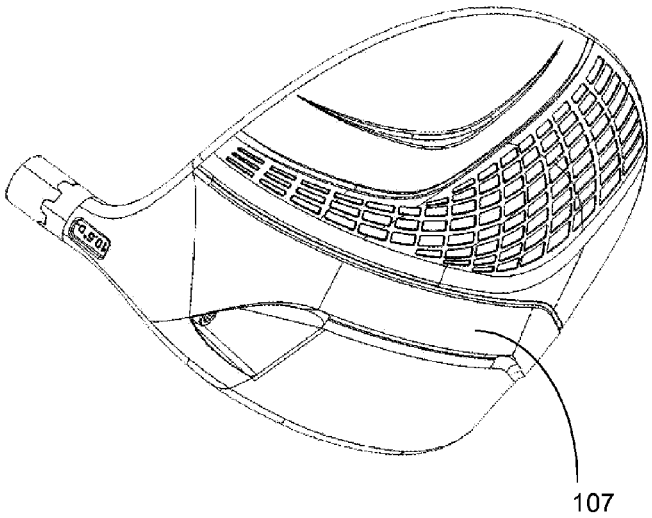
FIG. 10 is a bottom-rear perspective view of a golf club head according to certain embodiments of the invention.
Figure 11:
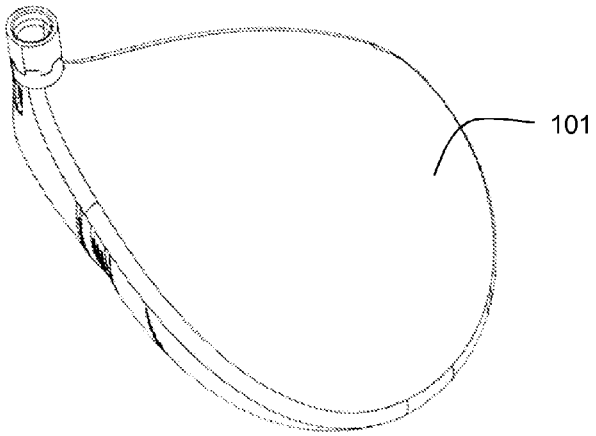
FIG. 11 is a top-rear perspective view of a golf club head according to certain embodiments of the invention.

FIGS. 7-11 show club heads of various embodiments of the invention. As presented herein throughout, no figure is limited to an embodiment illustrated by another figure. While a golf club head according to the invention can exhibit all the views shown in FIGS. 7-11, a head having a sole as shown in FIG. 10 need not have a crown as shown in FIG. 11, and so for any pair of figures herein. Except where otherwise indicated, any disclosed measurement or definition of a measurement may apply to any embodiment pictured or discussed herein.

Figure 12:
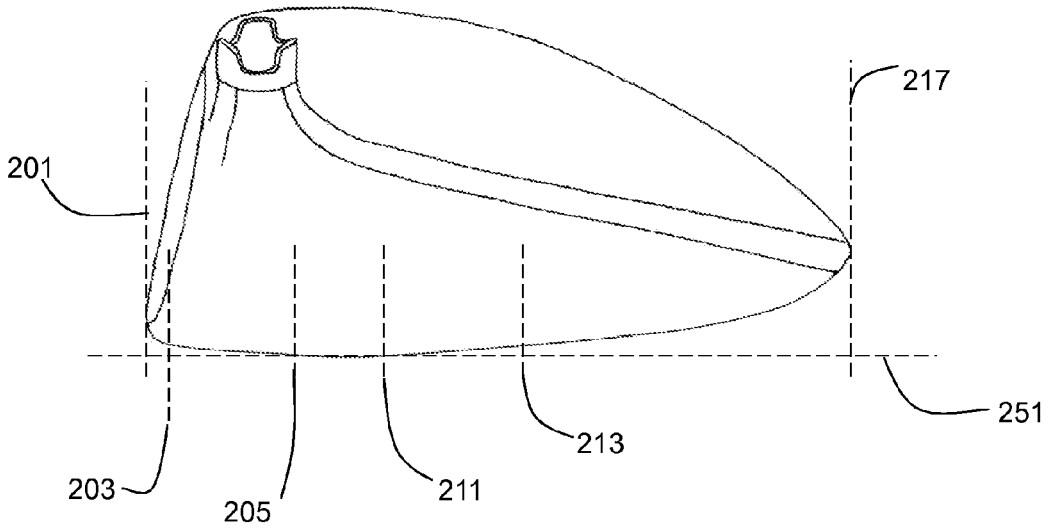
FIG. 12 is a side view of a golf club head according to certain embodiments of the invention showing boundaries of regions of a sole.

As shown in FIGS. 7-11, club head 101 has a region 107 that is generally the lowest area of the sole when the club head is at address. Region 107 can be discussed with reference to boundaries. FIG. 12 is a side view of a golf club head according to certain embodiments of the invention showing boundaries of regions of a sole.

As shown in FIG. 12, when club head 101 is at address on a plane 251, the foremost point of club head 101 defines a vertical plane at the front 201 of club head 101. Face-sole boundary 203 can be used to mark the fore edge of the sole. Region 107 begins at fore boundary 205. Region 107 is bounded in the aft direction by aft boundary 211.

For the purposes of describing region 107 according to the discussion below, a rear sole boundary 213 is defined as a plane a distance E back from aft boundary 211 that is the same as a distance E between fore boundary 205 and face-sole boundary 203. The rear-most point of club head 101 defines a vertical plane at the back 217 of the head, parallel to the plane at the front 201 of the head, and both orthogonal to plane 251.

Figure 13:
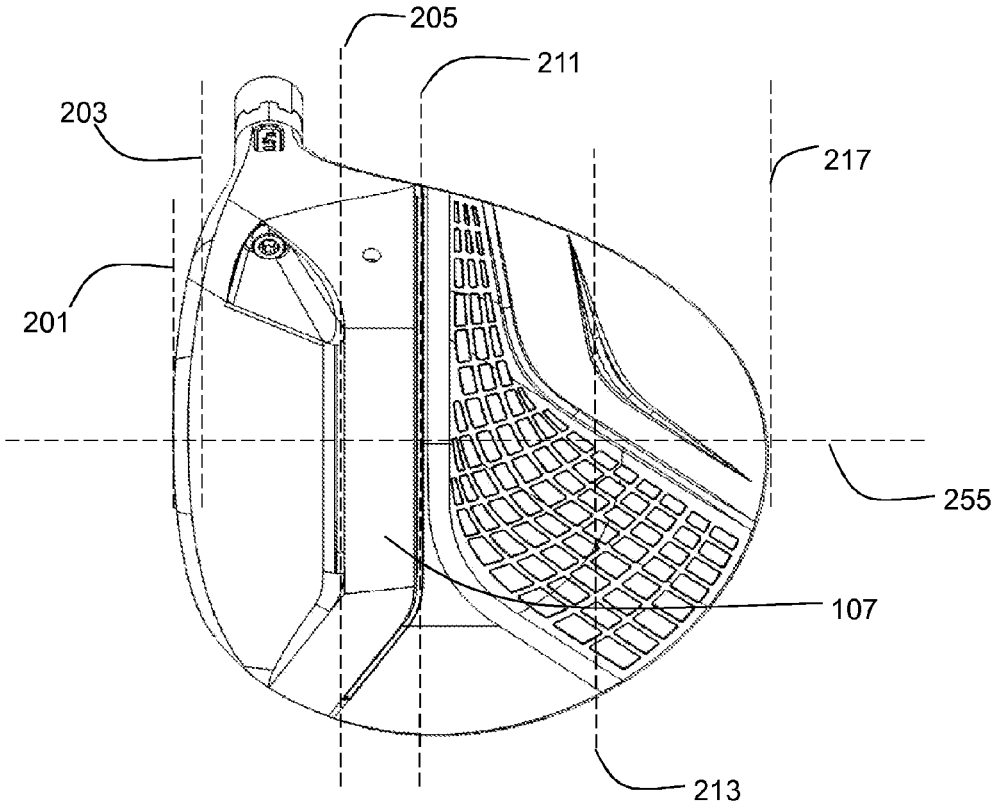
FIG. 13 is a bottom view of a golf club head according to certain embodiments of the invention showing boundaries of regions of a sole.

FIG. 13 is a bottom view of a golf club head according to certain embodiments of the invention showing boundary regions of a sole. Fore boundary 205 and aft boundary 211 bound region 107 in the fore-aft direction.

Generally a club head 101 may have a transition between a face and a sole having length T (e.g., a rounded region, angled region, stepped region, or sharp region). Face-sole boundary 203 marks an edge between that transition and the substantially downward-facing sole. Rear sole boundary 213 is defined as the same distance E from aft boundary 211 as the distance E between fore boundary 205 and face-sole boundary 203. Fore-aft line 255, perpendicular to front plane 201 and lying along ground plane 251 through a club contact point 42 can be used to measure these distances.

Figure 14:
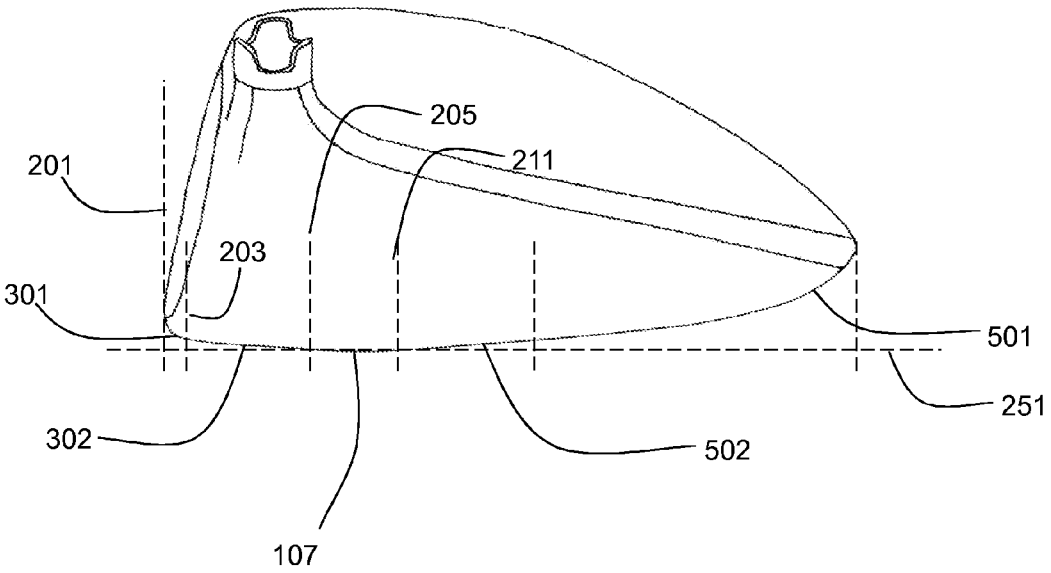
FIG. 14 is a side view of a golf club head according to certain embodiments of the invention showing regions of a sole.
Figure 15:
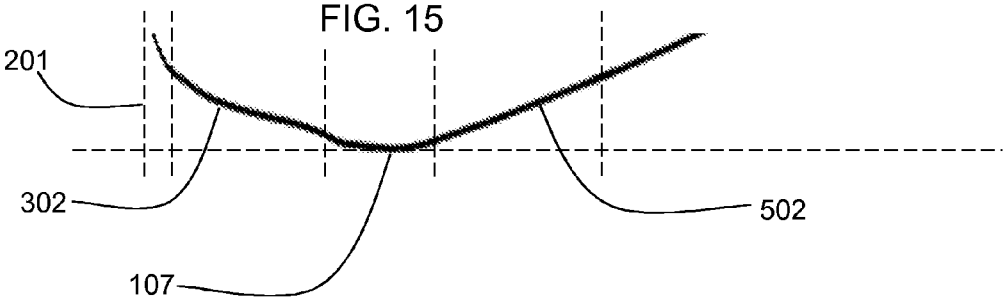
FIG. 15 is a side view of a golf club head according to certain embodiments of the invention, exaggerated in the vertical direction and showing regions of a sole.
Figure 16:
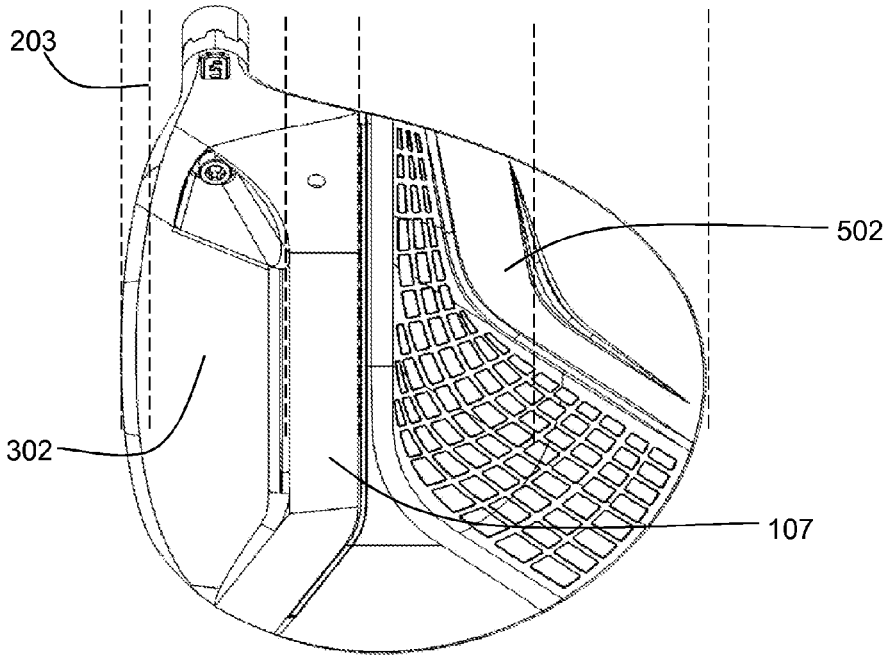
FIG. 16 is a bottom view of a golf club head according to certain embodiments of the invention showing regions of a sole.

FIGS. 14-16 illustrate regions of a sole defined by these boundaries. Particular reference is made to fore sole 302, region 107, and aft sole 502. Fore sole 302 is the area between fore boundary 205 and face-sole boundary 203. Region 107 is the area between fore boundary 205 and aft boundary 211. Aft sole 502 is the region between aft boundary 211 and rear boundary 213. By definition, aft sole 502 has the same extent E in the fore-aft direction as fore sole 302.

FIG. 15 shows a detail view of the sole illustrated in FIG. 14, greatly exaggerated in the vertical direction. As can be seen in FIG. 15, region 107 presents the lowest area of the sole when the club head is at address. Further as can be seen in FIG. 15, club head 101 of the invention makes contact with ground plane 251 within region 107 when at address.

Figure 17:
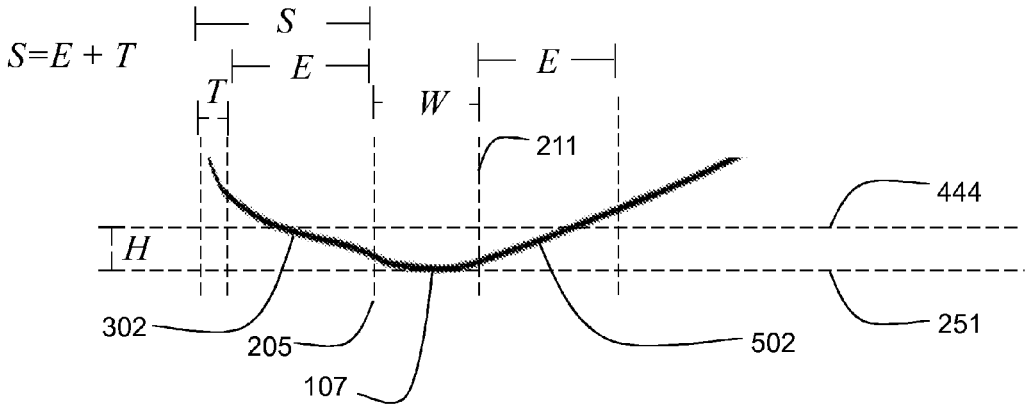
FIG. 17 is a side view of a golf club head according to certain embodiments of the invention, exaggerated in the vertical direction and showing measurements of a feature of the invention.

Turning now to FIG. 17, which presents the same detail view as presented in FIG. 15, dimensions of region 107 can be defined.

Figure 18:
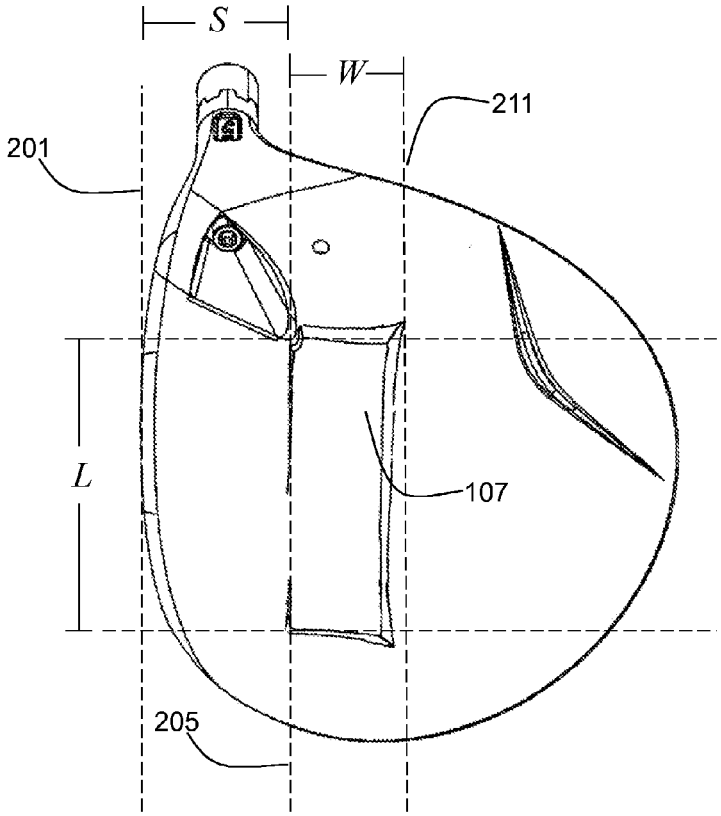
FIG. 18 is a bottom view of a golf club head according to certain embodiments of the invention showing measurements of a feature of the invention.

As shown in FIGS. 17 and 18, a distance between fore boundary 205 and aft boundary 211 measured along fore-aft line 255 can define a width W of region 107. A distance between front 201 and fore boundary 205 measured along fore-aft line 255 can define a setback S of region 107.

A length or extent E of fore sole 302 can be defined as a setback S of region 107 minus a length T of the face-sole transition. Alternatively, an extent E of fore sole 302 can be defined as an arbitrary measurement forward from fore boundary 205. Alternatively, in some embodiments, an extent E of fore sole 302 is equal to a width W of region 107. An extent E of aft sole 502 is, by definition, equal to an extent E of fore sole 302.

When club head 101 is at address, the average distance of fore sole 302 and aft sole 502 along fore-aft line 255 from ground plane 251 is shown by average sole height line 444. The vertical distance between height line 444 and ground plane 251 can define a height H of region 107.

Region 107 can be described with reference to a length L measured in a heel-toe direction.

Thus, according to the foregoing discussion, club head 101 according to embodiments of the invention generally has a protruding region 107 on the sole having a width W, a height H, and a length L, and being spaced away from the face of the club by a setback S. FIG. 18 shows region 107 having a generally rectangular shape in plan-view (i.e., map view). Region 107 need not have a rectangular shape in plan view and can be round, oblong, irregular, oval, curved, or any other shape. Generally, region 107 can be described with reference to width W, height H, and length L as maximum width W, maximum height H, and maximum length L, and setback S as minimum setback S.

Generally, S is greater than about 0.5 cm, L is more than about 0.5 cm, W is more than about 0.5 mm, and H is more than about 0.1 mm. In certain embodiments, S is between about 2.5 cm and about 3.5 cm; L is between about 2.5 cm and about 12 cm; W is between about 3 mm and about 25 mm; and H is between about 0.3 mm and about 2 mm. For example, S can be between about 2.8 cm and about 3.3 cm; L can be greater than about 1 cm; W can be between about 9 mm and about 20 mm; and H can be between about 0.1 mm and about 3 mm. Any combination of measurements disclosed herein is within the scope of the invention. For example, in certain embodiments, S is more than about 2.5 cm; L is greater than about 1 cm; W is between about 9 mm and about 20 mm; and H is between about 0.3 mm and about 2 mm.

Golf club head 101 having region 107 according to embodiments of the invention exhibits desirable behaviors, particularly an adjustable loft that does not affect the face angle when the club is at address.

Figure 19:
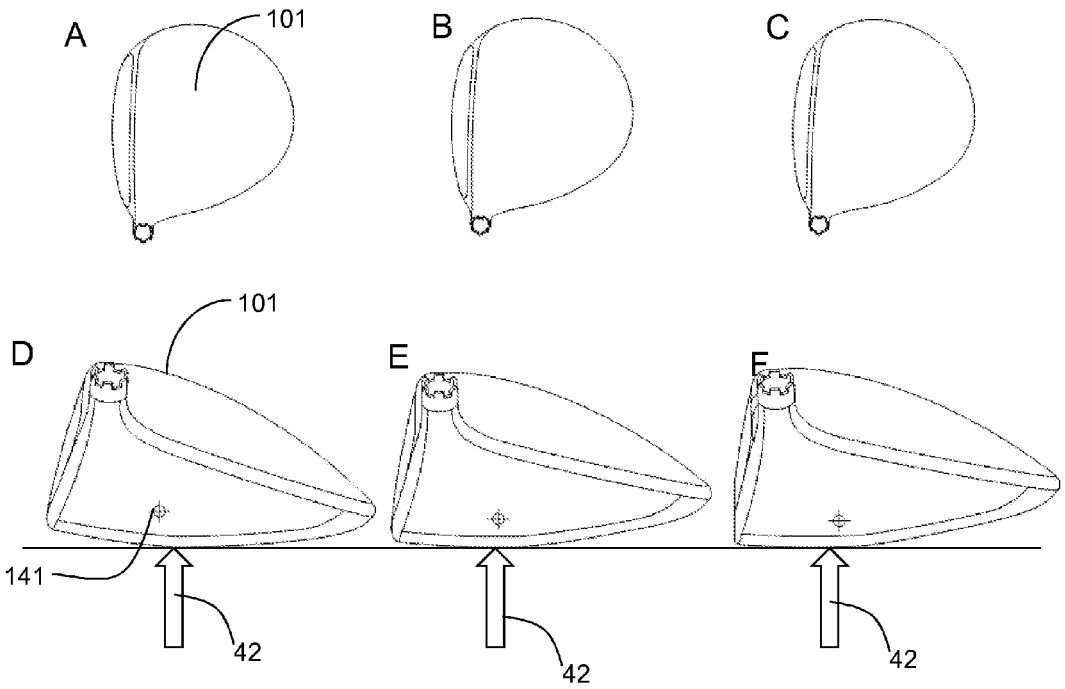
FIG. 19 illustrates properties of features of the invention.

As shown in FIG. 19, whether club head 101 has an 11.5° loft angle (panel D), a 10° loft angle (panel E), or an 8.5° loft angle (panel F), club head 101 exhibits a substantially neutral face angle. Further, this relationship holds for any face angle.

If club head 101 is set to have an open face angle, for example, and the loft is adjusted, club head 101 will still exhibit an open face angle (and so for a closed face angle).

Figure 20:
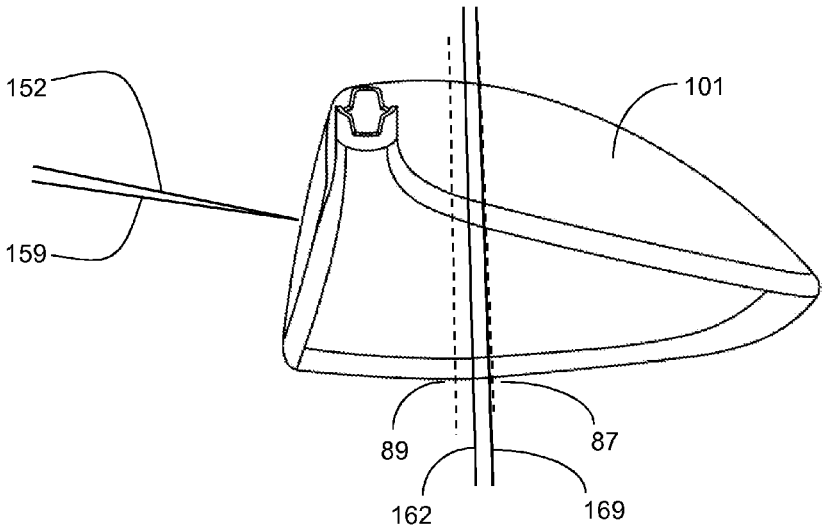
FIG. 20 illustrates properties of features of the invention.

Without being bound by any theory of operation, FIGS. 19 and 20 illustrate properties of club head 101. When set with high loft 152, contact point 87 is close to balance line 162. When set with low loft 159, contact point 89 is relatively close to balance line 169. In each loft setting, club head 101 makes contact with the ground through a portion of the material within region 107.

Figure 21:
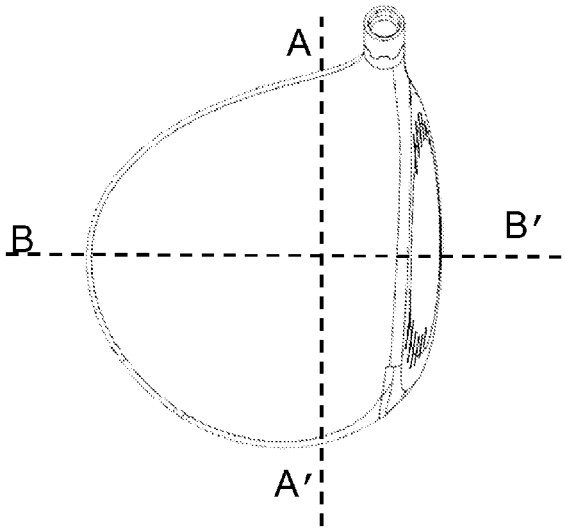
FIG. 21 is a top view of a golf club head according to certain embodiments of the invention.
Figure 22:
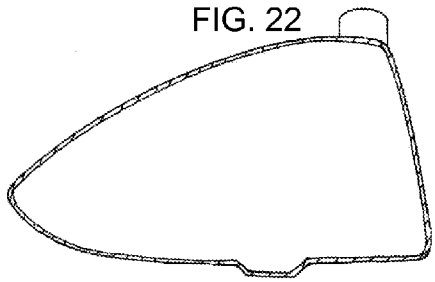
FIG. 22 is a cross-sectional view of a golf club head according to certain embodiments of the invention, taken along a line corresponding to line B-B' in FIG. 21.

FIG. 21 is a top view of club head 101. FIG. 22 is a cross-sectional view of a golf club head according to certain embodiments of the invention, taken along a line corresponding to line B-B' in FIG. 21. In some embodiments, club head 101 has a shape illustrated in FIGS. 22-33, however, FIGS. 22-33 can represent exaggerations of a shape of club head 101. In general, these figures illustrate a general morphology, and dimensions may be referred to independently of any figure.

Figure 23A:
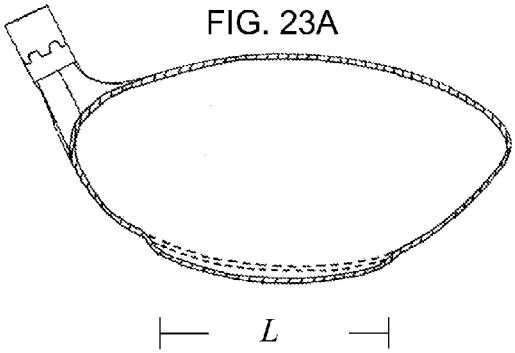
FIGS. 23A-C are each a cross-sectional view of a golf club head according to certain embodiments of the invention, taken along a line corresponding to line A-A' in FIG. 21.
Figure 23B:
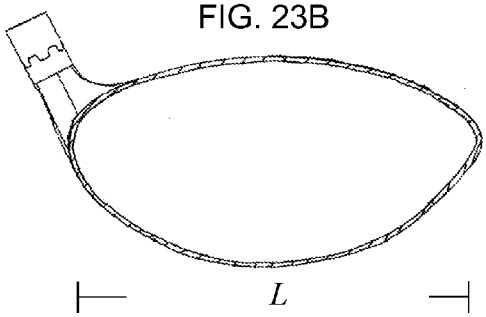
Figure 23C:
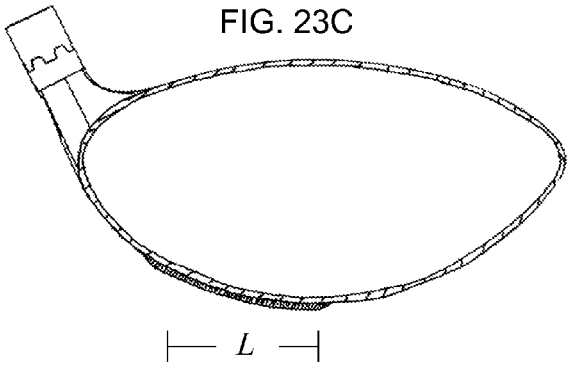

FIGS. 23A-C are each a cross-sectional views of a golf club head according to certain embodiments of the invention, taken along a line corresponding to line A-A' in FIG. 21. As shown in FIG. 23A, region 107 may protrude down from club head 101 such that it has a length L in the heel-toe direction between about 5 cm and about 9 cm. As shown in FIG. 23B, region 107 may smoothly span from the heel to the toe of club head 101, such that it has a length L between about 9 cm and about 13 cm. As shown in FIG. 23C, region 107 may have a length L between about 3 cm and about 5 cm. Moreover, as shown in FIG. 23C, region 107 may be off-center in a heel-toe dimension, in either direction or by any amount. In some embodiments, region 107 is centered, biased towards a heel, or biased towards a toe.

Figure 24:
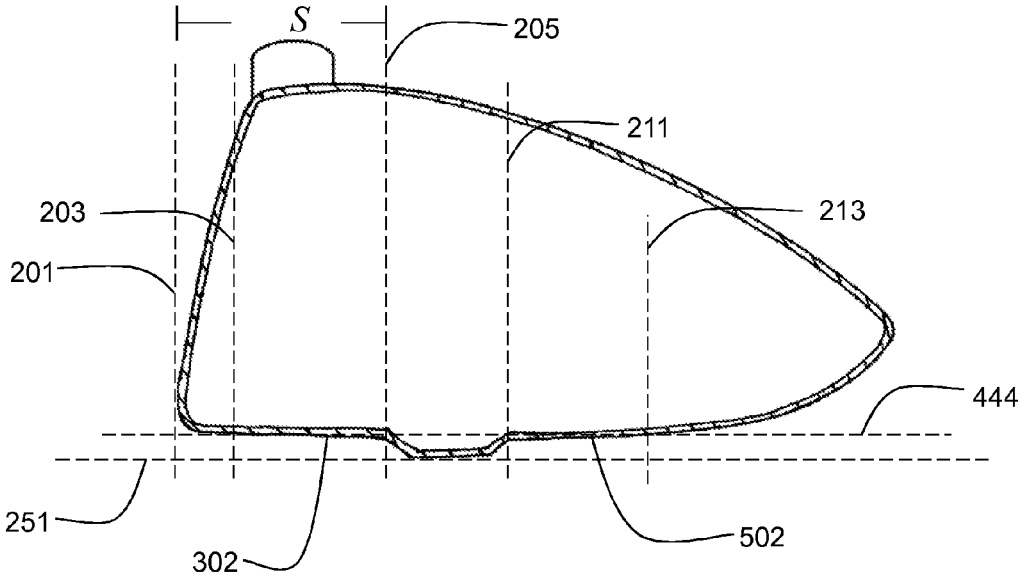
FIG. 24 is a cross-sectional view of a golf club head according to certain embodiments of the invention, taken along a line corresponding to line B-B' in FIG. 21.
Figure 25:
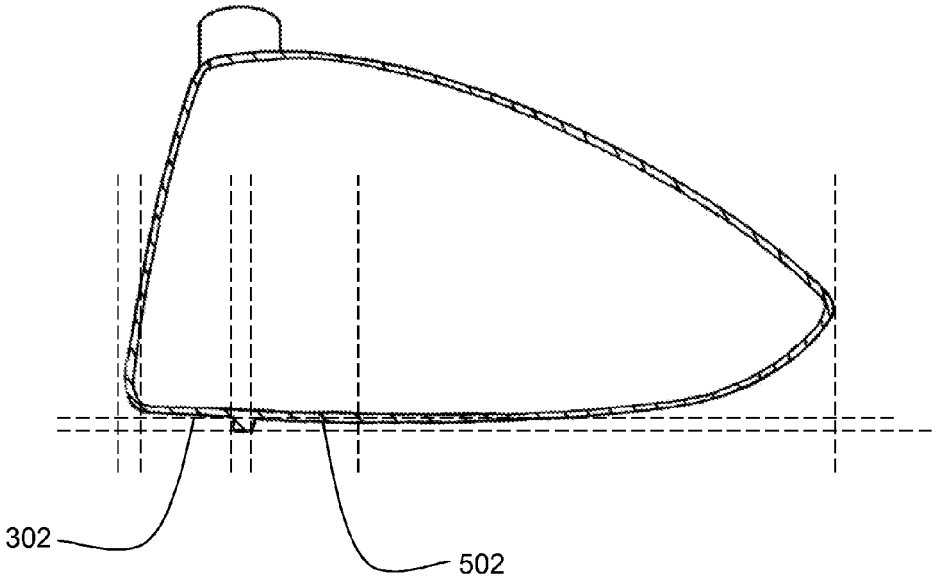
FIG. 25 is a cross-sectional view of a golf club head according to certain embodiments of the invention, taken along a line corresponding to line B-B' in FIG. 21.
Figure 26:
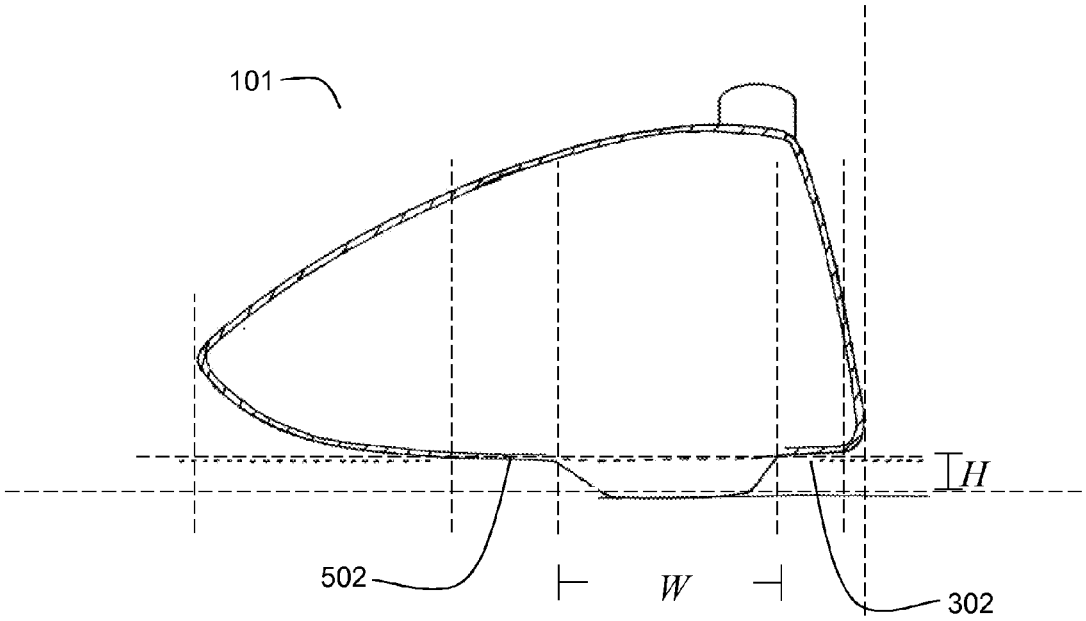
FIG. 26 is a cross-sectional view of a golf club head according to certain embodiments of the invention, taken along a line corresponding to line B-B' in FIG. 21.
Figure 27:
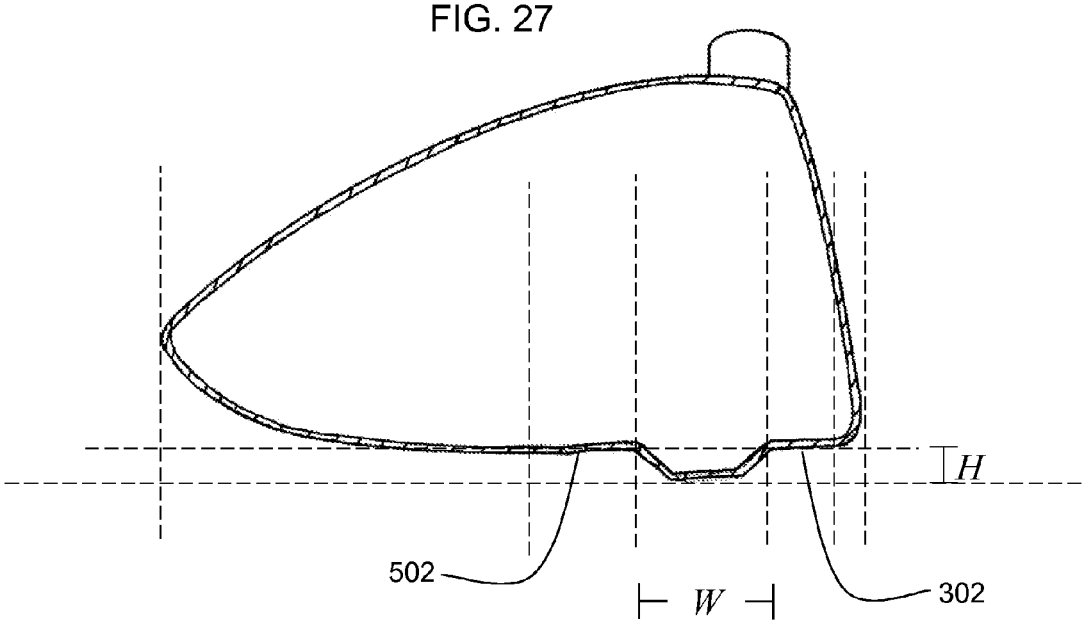
FIG. 27 is a cross-sectional view of a golf club head according to certain embodiments of the invention, taken along a line corresponding to line B-B' in FIG. 21.

FIGS. 24-27 are cross-sectional views according to certain embodiments of the invention, taken along a line corresponding to line B-B' in FIG. 21. As shown in FIG. 24. a setback S can be between about 3 cm and about 6 cm or a width W can be between about 0.5 cm and about 4 cm. As shown in FIG. 25, a setback S can be between about 1 cm and about 3 cm, or a width W can be between about 0.1 mm and about 9 mm. As shown in FIG. 26, a setback S can be between about 1 cm and about 3 cm, or a width W can be between about 0.5 cm and about 6 cm. As shown in FIG. 27, a setback S can be between about 0.5 cm and about 4 cm or a width W can be between about 0.5 cm and about 4 cm.

As shown in FIGS. 24-27, an extent E of fore sole 302 (by definition, equal to an extent E of aft sole 502) can be between about 0.3 cm and about 6 cm.

As discussed above, region 107 can be described with reference to length, width, height, and setback. Independently or additionally region 107 can be described according to other aspects of club head 101. Club head 101 will generally exhibit certain geometric properties as described herein.

Figure 28:
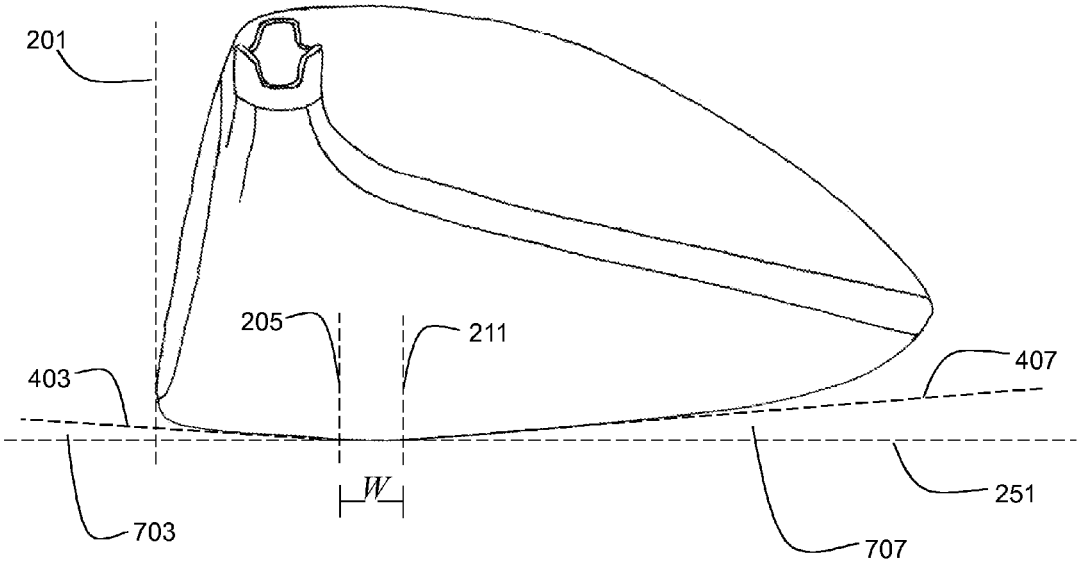
FIG. 28 is a side view of a golf club head according to certain embodiments of the invention.

FIG. 28 shows a side view of club head 101 according to certain embodiments of the invention at address. As shown in FIG. 28, region 107 is generally disposed between fore boundary 205 and aft boundary 211. As shown in FIG. 28, club head 101 has a loft between about 10° and about 11°.

Fore boundary 205 intersects ground plane 251 defining an intersection line. A front plane 403 intersects this line at a setback distance S from the front of the club, defining a fore angle 703 of X degrees with the ground. Front plane 403 is tangent to the sole.

Aft boundary 211 intersects ground plane 251 along a line. A back plane 407 intersects this line and is tangent to the sole. Back plane 407 defines a back angle 707 of Y degrees with ground plane 251.

When club head 101 is at address and resting on a plane 251, the sole makes contact with the surface within region 107 and X+Y is greater than 0°. In certain embodiments, X+Y is between about 0.01° and about 40°. Setback S and width W can each independently be any measurement. For example, setback S can be between about 5 mm and about 80 mm. Width W can be between about 1 mm and about 60 mm. Preferably, S is between about 20 mm and about 40 mm, e.g., between about 30 mm and about 35 mm, while W is between about 5 mm and about 30 mm, e.g., between about 5 mm and about 15 mm or between about 15 mm and about 25 mm. Preferably X+Y is between about 3° and about 23° (e.g., between about 5° and about 12°).

FIGS. 29-33 each show a cross-sectional view of a golf club head according to certain embodiments of the invention, taken along a line corresponding to line B-B' in FIG. 21. As shown in FIGS. 29-33, a region 107 can be provided on a club head such that a front plane 403 (tangent to the sole) meets ground plane 251 at fore boundary 205 to define a fore angle 703 of X degrees with ground plane 251. Front plane 403 is tangent to the sole. Similarly, back plane 407 (tangent to the sole) meets ground plane 251 at aft boundary 211 to define a back angle 707 of Y degrees with ground plane 251. When club head 101 is at address with a loft between about 10° and about 11°, each of X or Y may independently be between about 0.5° and about 8°, preferably between about 1° and about 8°. In certain embodiments, either of X or Y is between about 0.5° and about 5° (e.g., X between about 1.5° and about 5° and Y between about 0.5° and about 5°).

In a preferred embodiment, where club head 101 is part of a club having a loft that is adjustable from a minimum loft P to a maximum loft Q, the following will hold:

$$(X+Y)\geq(Q-P) \tag{1}$$

As shown in equation 1, fore angle 703 and back angle 707 together preferably define a range equal to or greater than the total range of adjustable loft for club head 101. Accordingly, in certain embodiments, a golf club is provided in which the loft can be set at two or more effective settings including a setting at about 8.5° loft and a setting at about 11.5° (range of adjustable loft is at least about 3°), and a sole of the club head has a region 107 with boundaries that define a front plane 403 and a back plane 407 (both tangent to the sole) creating angles with the ground that together are at least about 3°.

Figure 29:
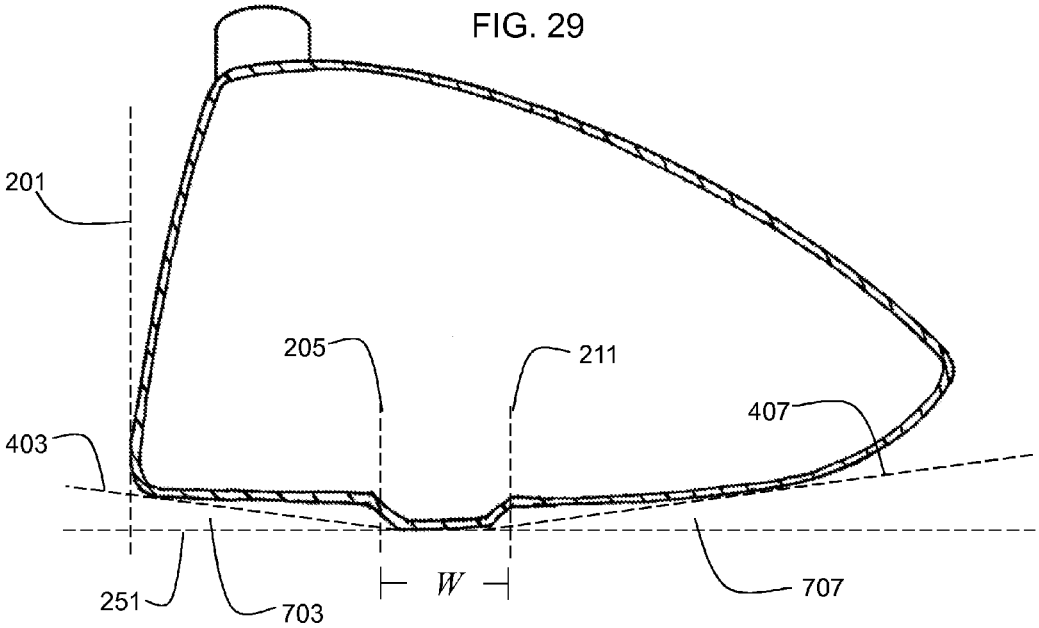
FIG. 29 is a cross-sectional view of a golf club head according to certain embodiments of the invention, taken along a line corresponding to line B-B' in FIG. 21.
Figure 30:
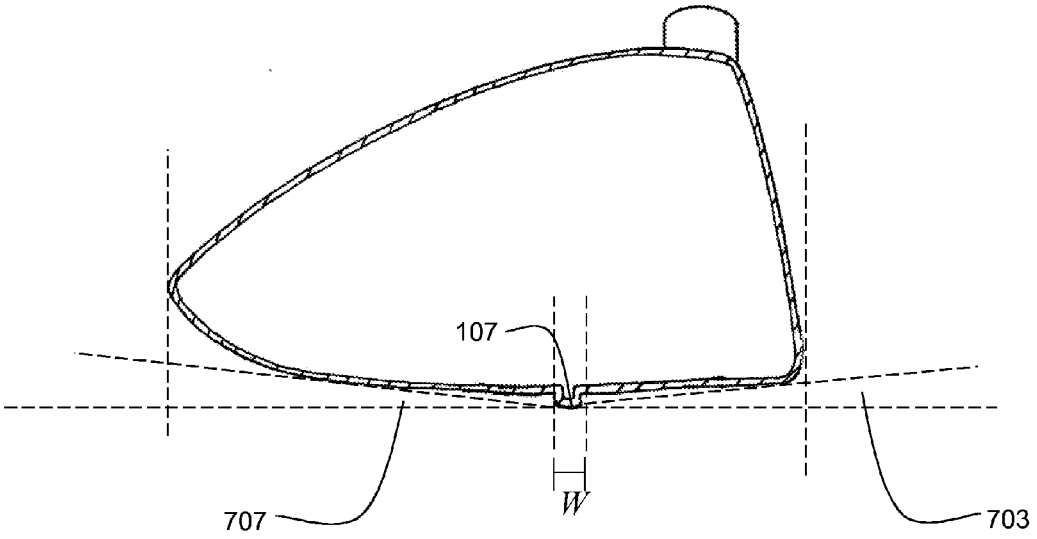
FIG. 30 is a cross-sectional view of a golf club head according to certain embodiments of the invention, taken along a line corresponding to line B-B' in FIG. 21.
Figure 31:
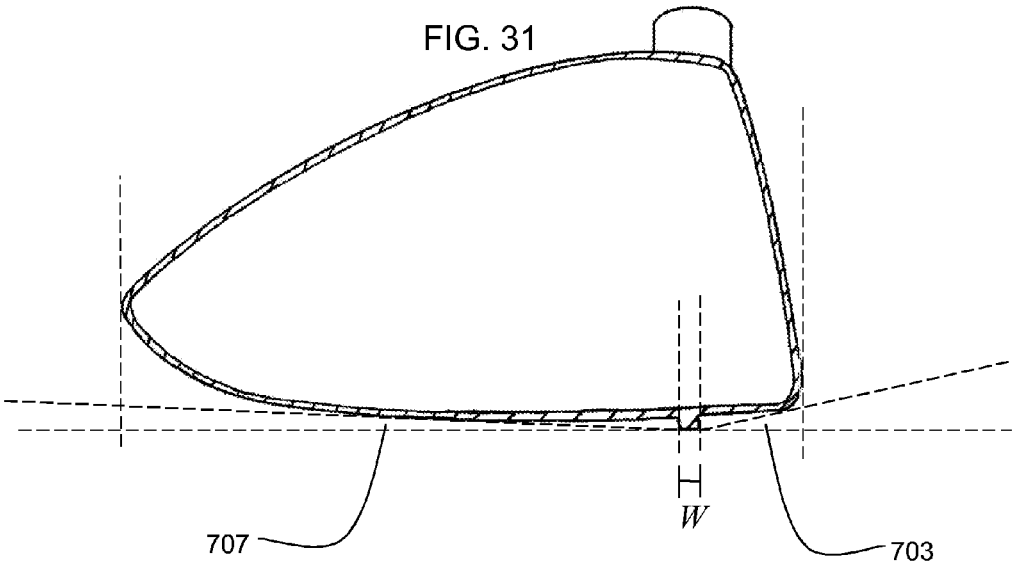
FIG. 31 is a cross-sectional view of a golf club head according to certain embodiments of the invention, taken along a line corresponding to line B-B' in FIG. 21.
Figure 32:
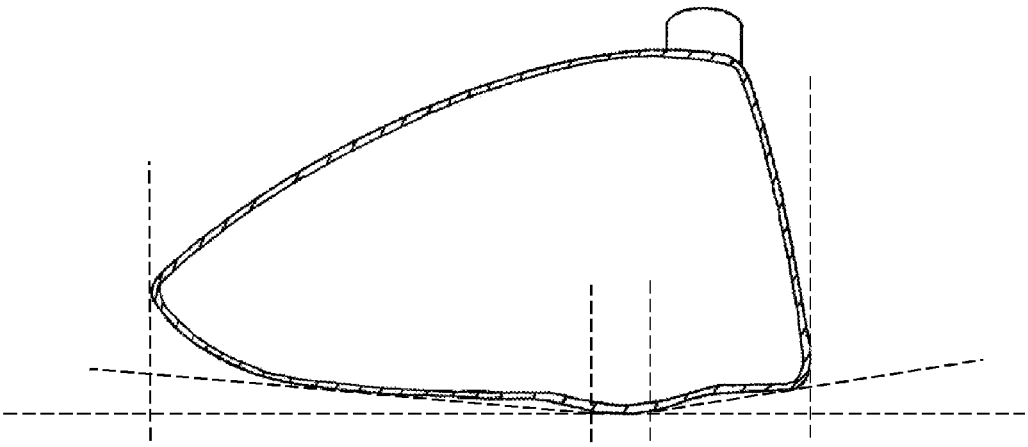
FIG. 32 is a cross-sectional view of a golf club head according to certain embodiments of the invention, taken along a line corresponding to line B-B' in FIG. 21.
Figure 33:
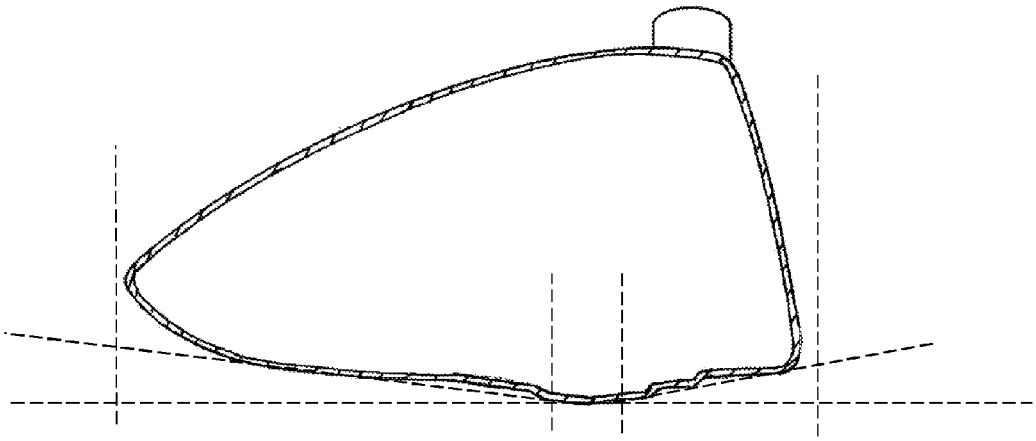
FIG. 33 is a cross-sectional view of a golf club head according to certain embodiments of the invention, taken along a line corresponding to line B-B' in FIG. 21.

FIG. 29 shows a cross sectional view illustrating one embodiment of the invention. As seen by comparing FIGS. 29-33, this geometry is attainable with various combinations of setback S and width W and morphologies of the sole of club head 101.

Figure 34:
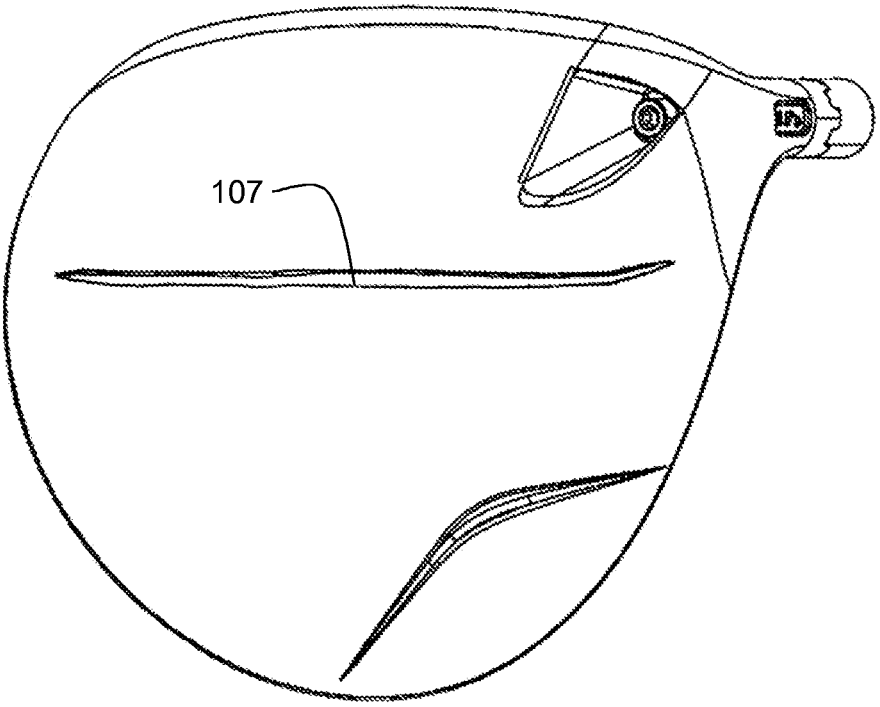
FIG. 34 is a bottom view of a golf club head according to certain embodiments of the invention.
Figure 35:
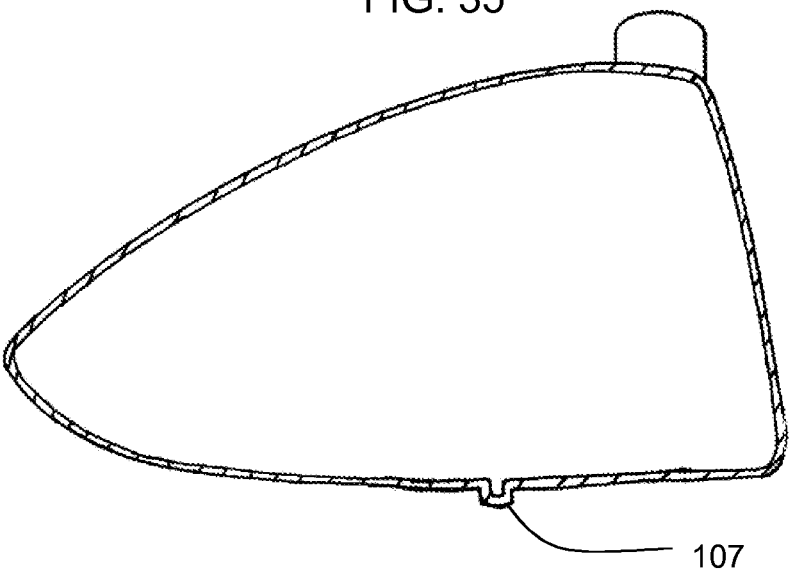
FIG. 35 is a cross-sectional view of a golf club head according to certain embodiments of the invention, taken along a line corresponding to line B-B' in FIG. 21.

Region 107 of club head 101 will generally satisfy at least one of the foregoing descriptions. A variety of embodiments are provided by the invention. For example, FIG. 34 shows a bottom view of club head 101 having a thin bar-like region 107 extending in a heel-toe direction. FIG. 35 shows a cross section view of a thin bar-like region 107. As shown in FIG. 34 or FIG. 35, region 107 can have a setback S between about 30 mm and about 35 mm or a width W between about 1 mm and about 9 mm.

Figure 36:
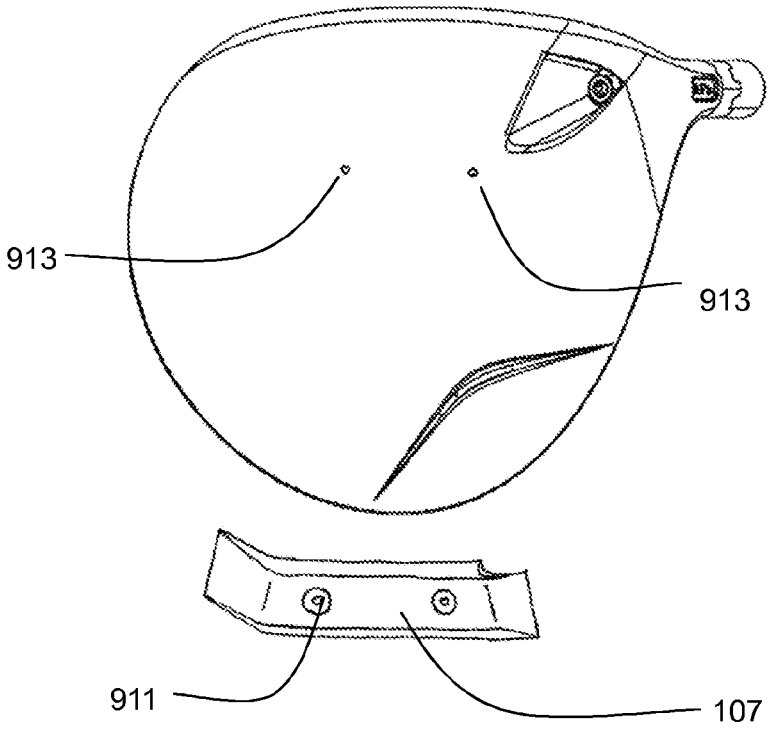
FIG. 36 is a bottom view of a golf club head with an attachable feature according to certain embodiments of the invention.
Figure 37:
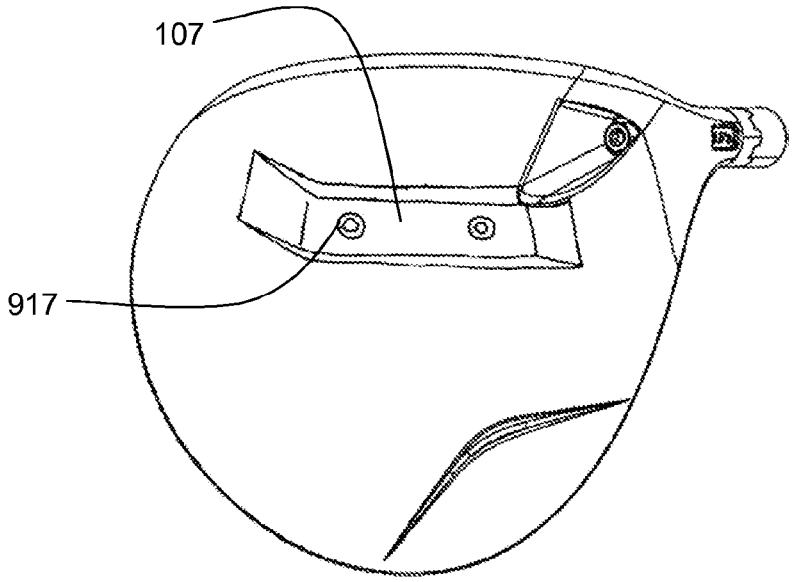
FIG. 37 is a bottom view of a golf club head with an attached feature according to certain embodiments of the invention.

In some embodiments, region 107 is provided by a separate component. For example, FIG. 36 shows a separate component providing region 107. The component has one or more fastening holes 911 positioned to correspond to anchor holes 913 on club head 101. FIG. 37 shows club head 101 having the component installed.

Figure 38:
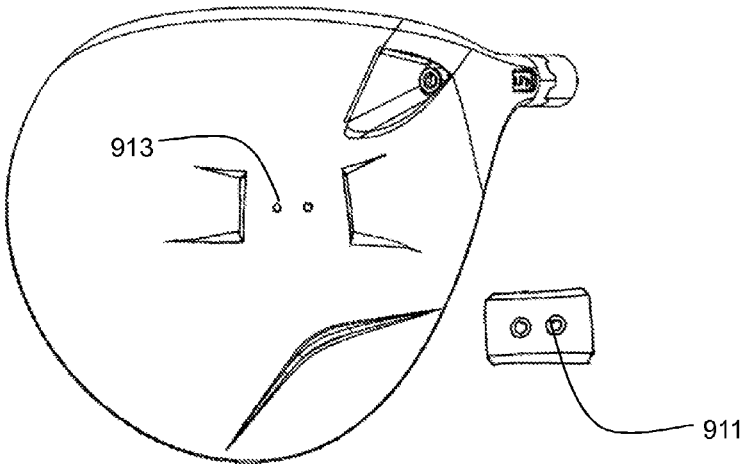
FIG. 38 is a bottom view of a golf club head with an attachable feature according to certain embodiments of the invention.
Figure 39:
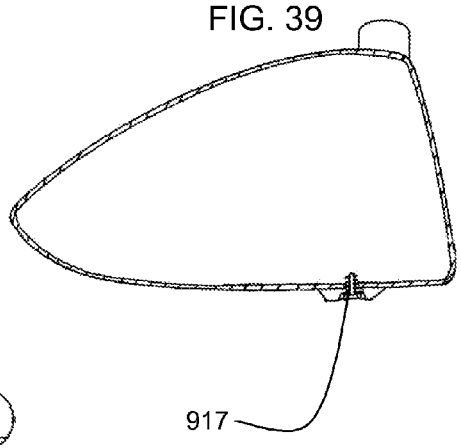
FIG. 39 is a cross-sectional view of a golf club head with an attached feature according to certain embodiments of the invention, taken along a line corresponding to line B-B' in FIG. 21.
Figure 40:
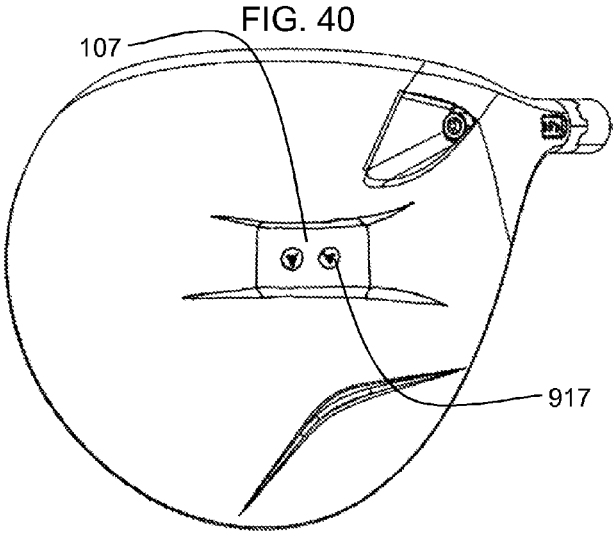
FIG. 40 is a bottom view of a golf club head with an attached feature according to certain embodiments of the invention.

In another example, FIG. 38 is a bottom view of a golf club head with an attachable feature according to certain embodiments of the invention. As shown in FIG. 38, the attachable component is configured to fit with one or more braze-ons or ramps (which may be welded, glued, riveted, molded, cast, or otherwise formed to club head 101). FIG. 39 shows a cross sectional view through fastening hole 911 and hardware element 917 (e.g., a screw or bolt) of club head 101 with attachable region 107 attached. FIG. 40 shows a bottom view of club head 101 with attachable region 107 attached. As shown in FIG. 40, region 107 may be biased, e.g., in a heel direction. For example, in the heel-toe direction, region 107 may begin near the center of the sole, and have a length L between about 1.5 cm and about 7.5 cm.

Figure 41:
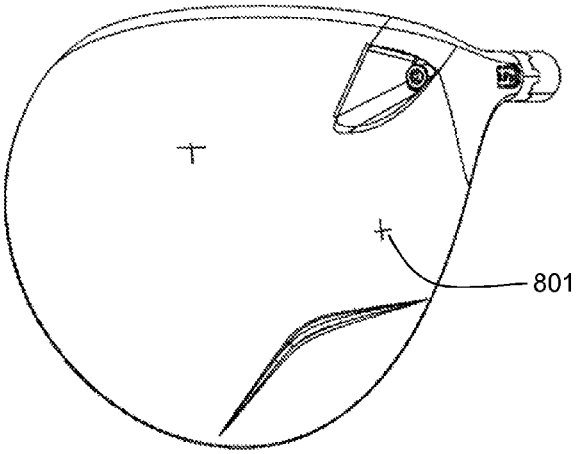
FIG. 41 is a bottom view of a golf club head with an attachable feature according to certain embodiments of the invention.
Figure 41:
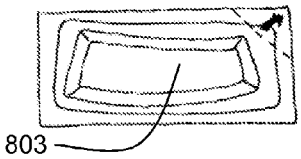
Figure 42:
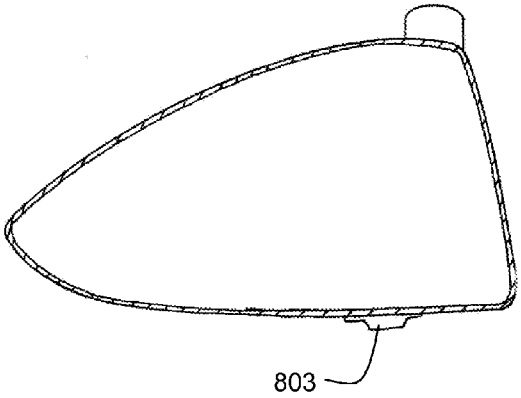
FIG. 42 is a cross-sectional view of a golf club head with an attached feature according to certain embodiments of the invention, taken along a line corresponding to line B-B' in FIG. 21.
Figure 43:
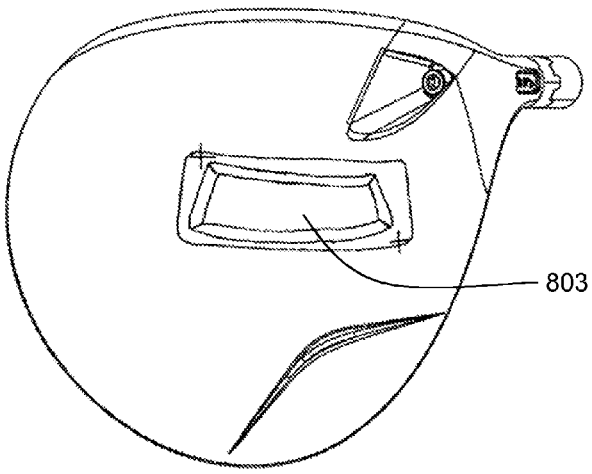
FIG. 43 is a bottom view of a golf club head with an attached feature according to certain embodiments of the invention.

In another example, FIG. 41 is a bottom view of a golf club head with an attachable feature according to certain embodiments of the invention. As shown in FIG. 41, region 107 is provided by an adhesive-backed element, here shown as a crack-and-peel accessory 803 (e.g., silicone polymer, rubber, molded or pliable plastic, cell phone, etc.). The sole of club head 101 can optionally be printed with registration marks 801 in any pattern, arrangement, color, or appearance, to show a suggested installation position for adhesive-backed accessory 803. FIG. 42 is a cross-sectional view showing installed accessory 803 to provide a region 107 meeting aspects of the region discussed above. FIG. 43 is a bottom view of club head 101 showing installed accessory 803.

Figure 44:
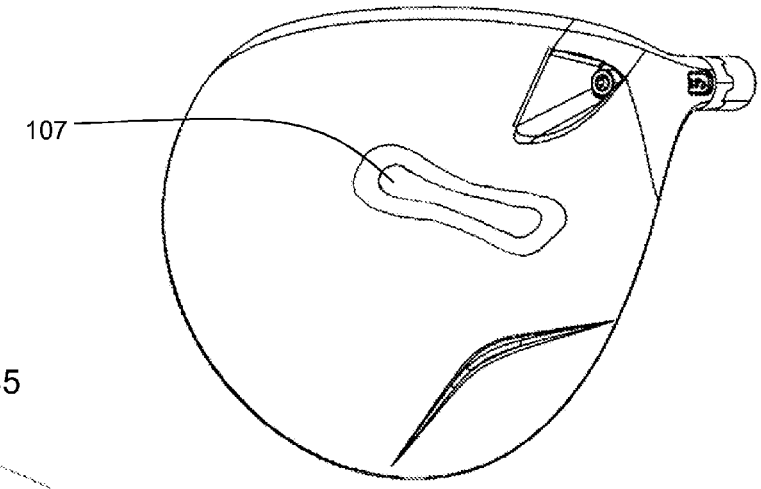
FIG. 44 is a bottom view of a golf club head according to certain embodiments of the invention.
Figure 45:
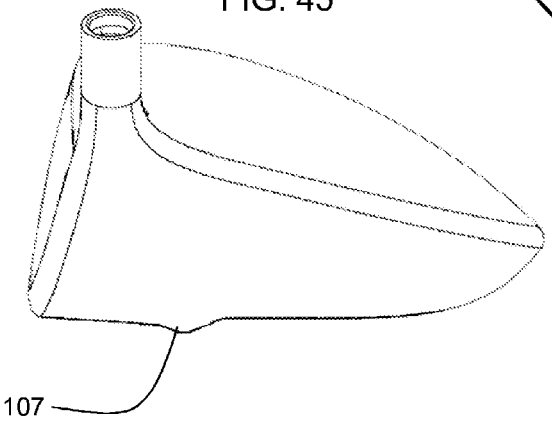
FIG. 45 is a side view of a golf club head according to certain embodiments of the invention.
Figure 46:
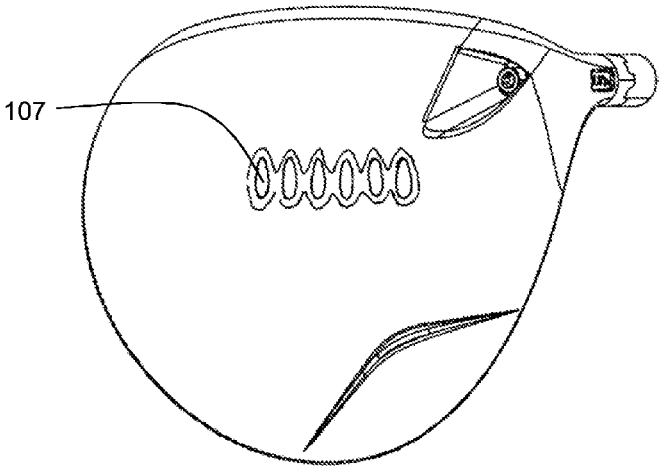
FIG. 46 is a bottom view of a golf club head according to certain embodiments of the invention.

FIGS. 44-46 show region 107 being provided by "irregular" or non-rectangular areas of contours on the sole of club head 101. The lines in FIG. 44 or FIG. 46 may represent contour lines and need not be visible as lines on a sole. As shown in FIG. 44, region 107 may be provided as a somewhat oblong bi-lobed shape. Region 107 could be oval or teardrop shaped or any other shape. FIG. 46 shows region 107 provided by about six substantially parallel tear-drop shaped contours, for example, to provide smooth turf interaction for club head 101.

Figure 47:
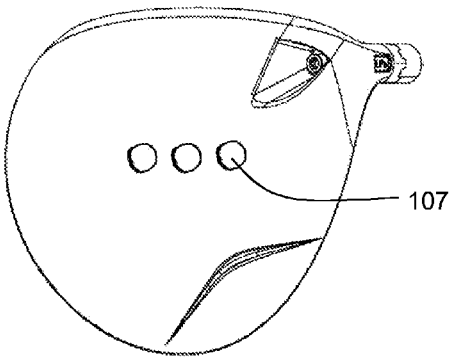
FIG. 47 is a bottom view of a golf club head according to certain embodiments of the invention.
Figure 48:
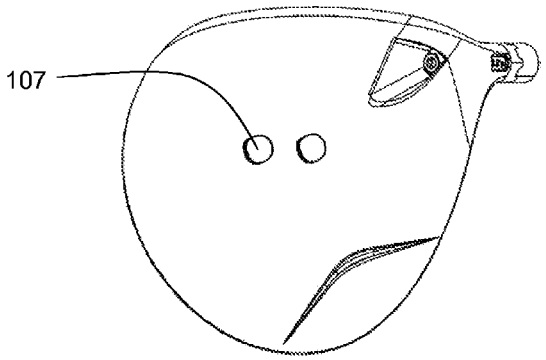
FIG. 48 is a bottom view of a golf club head according to certain embodiments of the invention.
Figure 49:
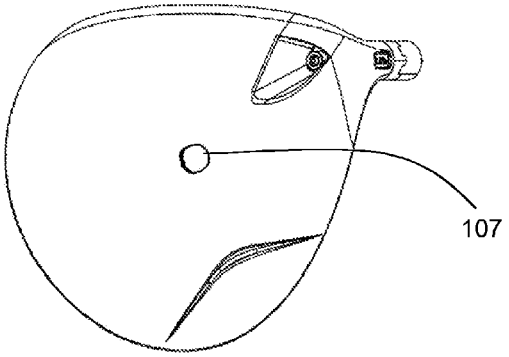
FIG. 49 is a bottom view of a golf club head according to certain embodiments of the invention.

FIGS. 47-50 show region 107 being provided by one or more discrete areas of relief. In FIGS. 47-50, a discrete area of relief is shown as a coin-shaped or button-like area, although any specific geometry is included in the invention. FIGS. 47, 48, and 49 show three, two, and one, respectively, areas of relief to provide region 107.

Figure 50:
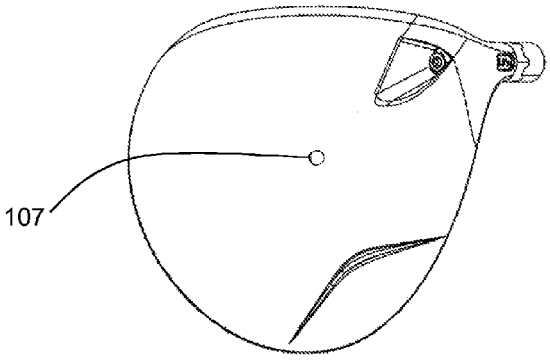
FIG. 50 is a bottom view of a golf club head according to certain embodiments of the invention.

FIG. 50 shows region 107 provided by a single small area of relief. Region 107 can have a length L between about 1 mm and about 5 mm, a width W between about 1 mm and about 5 mm, a height H between about 0.1 mm and about 3 mm, and setback S between about 5 mm and about 6 cm. Region 107 may provide fore angle 703 of X degrees and back angle 707 of Y degrees where each of X or Y may independently be between about 0.1° and about 8°, preferably between about 0.5° and about 4° (e.g., when club head is set at its centermost effective loft). Preferably, X+Y is between about 0.5° and about 7° in any loft setting. In some embodiments, region 107 is provided by a dot or "point-point" projection, i.e., having any height H described herein with an arbitrarily small length L and width W (e.g., less than about 1 mm).

Figure 51:
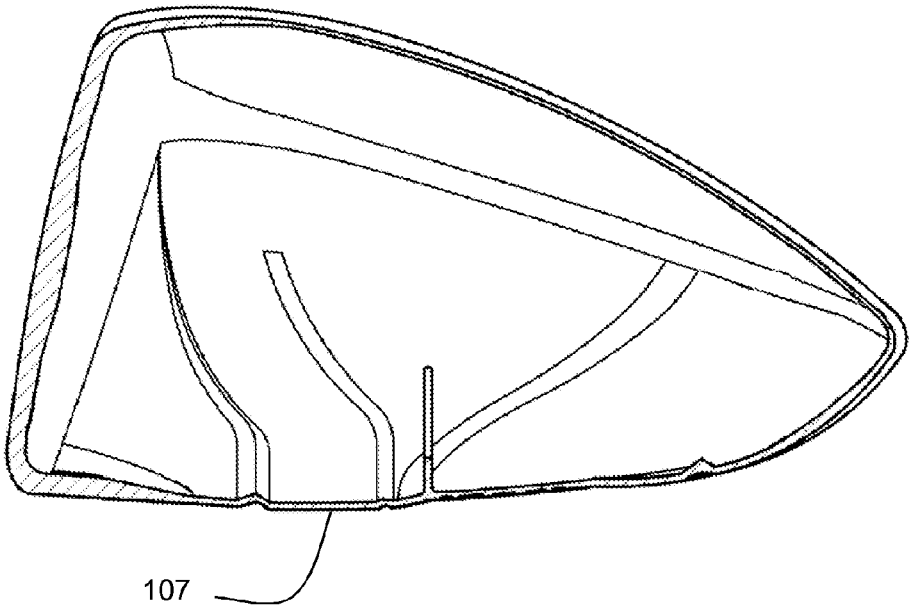
FIG. 51 is a cross-sectional view of a golf club head according to certain embodiments of the invention, taken along a line corresponding to line B-B' in FIG. 21.
Figure 52:
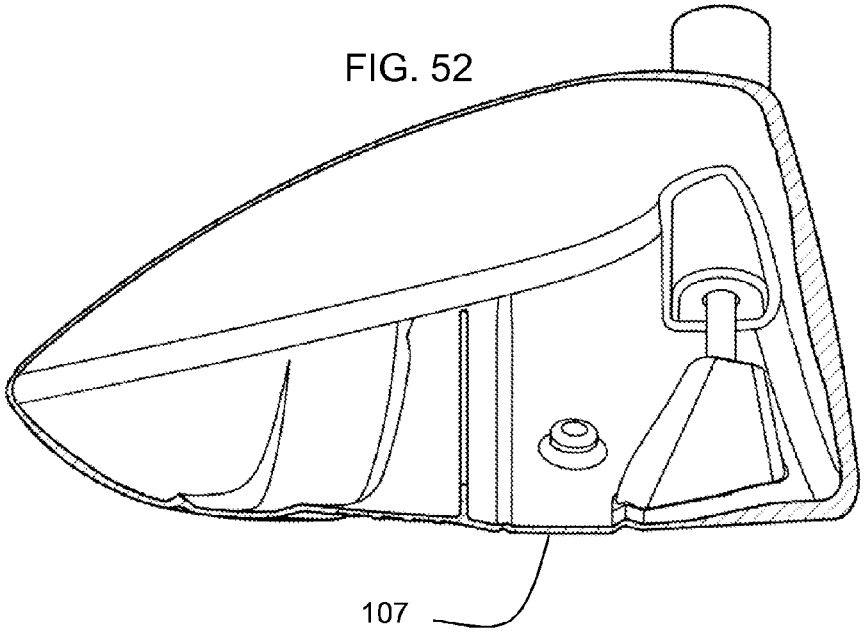
FIG. 52 is a cross-sectional view of a golf club head according to certain embodiments of the invention, taken along a line corresponding to line B-B' in FIG. 21.

FIGS. 51 and 52 each present a cross-sectional view of a golf club head according to certain embodiments of the invention, taken along a line corresponding to line B-B' in FIG. 21.

In various embodiments, region 107 is provided on drivers, hybrids, fairways, and irons. In certain embodiments, a fairway is provided in which the loft can be set at two or more effective settings including a setting at about 13° loft and a setting at about 16° (range of adjustable loft is at least about 3°), and a sole of the club head has a region 107 with boundaries that define a front plane 403 and a back plane 407 (both tangent to the sole) creating angles with the ground that together are at least about 3°. In certain embodiments, a hybrid is provided in which the loft can be set at two or more effective settings including a setting at about 16° loft and a setting at about 25° (range of adjustable loft is at least about 9°), and a sole of the club head has a region 107 with boundaries that define a front plane 403 and a back plane 407 (both tangent to the sole) creating angles with the ground that together are at least about 9°. In certain embodiments, an iron is provided in which the loft can be set at two or more effective settings and a sole of the club head has a region 107 with boundaries that define a front plane 403 and a back plane 407 (both tangent to the sole) creating angles with the ground that together are at least the difference between the two effective settings.

In certain aspects, the invention provides methods and systems for making, shipping, stocking, and selling golf clubs requiring only a single club head that satisfies consumer demand for different lofts and aesthetic features. For each of a plurality of customers, a golf club can be provided having a selected color, graphical depiction, loft, and/or face angle.

Due to the fact that a single club head of the invention can provide a club with a variety of features, such as color, graphics, and settings for loft or face angle, a store can stock fewer different club heads than would be required if only prior art club heads were available. Thus the invention allows for a configurable golf club to be provided that allows, for example, a store to sell golf clubs having a large number of configurations while only stocking a small number of club heads, shafts, and related hardware.

Accordingly, a golf club head having a sole with region 107 according to embodiments of the invention is provided for use with reconfigurable and interchangeable combinations of golf club parts (e.g., shafts, heads, ferrules, etc.). Mechanisms and methods for setting different club configurations are described in Interchangeable Shaft System, U.S. Pub. 2009/0197694; Interchangeable Shaft System, U.S. Pub. 2009/0264214; Interchangeable Shaft System, U.S. Pat. No. 7,699,717; Interchangeable Shaft System, U.S. Pub. 2011/0143854; Interchangeable Shaft and Club Head Connection System, U.S. Pat. No. 7,878,921; Interchangeable Shaft and Club Head Connection System, U.S. Pub. 2010/0261543; Interchangeable Shaft and Club head Connection System, U.S. Pub. 2009/0247316; Quick Release Connection System for Golf Clubs, U.S. Pub. 2008/0125239; Two-Part Hosel Connection System for Golf Clubs, U.S. Pub. 2008/0254909; and Interchangeable Shaft for a Golf Club, U.S. Pat. No. 7,476,160, the contents of each of which are herein incorporated by reference in their entirety.

Due to the fact that a club head of the invention prevents unwanted deviations from an intended orientation when held at address in different positions, a club head having a sole with region 107 according to embodiments of the invention is provided for use with any golf club (i.e., clubs that are not interchangeable, adjustable, or reconfigurable, as well as those that are). The invention provides a club head that can be permanently affixed to a shaft as well as other non-adjustable clubs.

Due to the fact that a club head of the invention enables a supplier (e.g., a store, pro-shop, wholesaler, sales rep, manufacturer, etc.) to offer a wider variety of clubs while stocking fewer independent parts, the invention provides the ability for a supplier to carry a greater variety of parts as defined by some other property, such as color, model, or trim level. For example, because a supplier can fit a customer with a driver having any loft and face angle using a single club head, a certain driver type can be provided for a large variety of customers using only a single stock-keeping unit (SKU) in a database or inventory system of the supplier. This means, relative to a supplier not using a club head of the invention, a large number of SKUs are "freed up" and can be used for other products. Similarly, a large amount of display space and storage space in the supply chain is likewise made available. Thus, these freed up resources can be used to provide clubs having, for example, a variety of colors.

Club heads of the invention enable suppliers to provide a variety of different clubs (e.g., requiring different SKUs, for example, one for each different color), where before, suppliers were limited to using those resources (SKUs and space) to carry enough versions of a single club head to satisfy the fitting requirements of a number of different customers.

The invention results in unexpected efficiencies in the manufacturing process because a club head can be brought to market having a variety of fits with only one form factor, a single manufacturing tool (e.g., mold) is required, thus lowering the cost of bringing a product to market. The single manufacturing tool can be used to produce club heads having a variety of colors, finishes, or "trim levels." Generally, trim level includes a brand name, decorative element, functional accessories, price, or combination thereof. For example, a driver may be sold having a single club head, but given both an SE and LE (e.g., "special edition" and "luxury edition") trim level, including silver stripes and a rubber grip on the SE model while having gold stripes, leather grip, and electronic components on the LE model. Also, the single manufacturing tool can be used to produce club heads having a variety of colors.

Because club heads that fit a variety of golfers can be made with a single tool, resources are freed to make club heads in a variety of colors and, more specifically, color can be provided in smaller runs, e.g., changed on a batch-by-batch basis. In some embodiments, the invention provides a set of club heads having a shared form factor and in a variety of colors. Club heads can be primary and secondary colors, fluorescent colors, regular or irregular patterns (e.g., plaid, speckled, tie-dyed, marbleized). Club heads can be made in limited runs having a distinctive color (e.g., the trademark color of a partnering luxury goods manufacturer or the trademark stripes or plaid pattern of a corporate partner).

Due to the fact that a manufacturer can offer a whole line of a particular club (e.g., a particular driver) to fit a variety of customers, by providing a single head, and that the color can be varied easily among the heads, manufacturers can offer distributors great flexibility and extensibility in the colors they offer to their customers. Due to this flexibility and extensibility, in certain embodiments, a retail store can offer clubs in small lots having truly customized colors. For example, a golf team or group can be provided with a set of clubs in which all of the club heads match the official colors of the group.

The invention provides personalized or customized color heads. Since all of a club head for a particular club can be provided by a single tool, manufacturing resources are greatly freed up by the invention. Thus, a manufacturer can repurpose its available resources, for example, to provide personalized customized color. In certain embodiments, a customer may choose a color (e.g., from a book, through an HTML color picker, etc.) or provide information about a color (e.g., provide a specimen, Pantone number, etc.) and a manufacturer can produce one or more club heads having the corresponding color.

A club head can be made having region 107 by any method known in the art. Club head 101 can be molded, cast, forged, or assembled from components by adhesives, welding, snap-fit, press-fit, or any other method known, or combination of any of the foregoing. Exemplary clubs and methods of making them are discussed in Multi-Piece Golf Club head with Improved Inertia, U.S. Pub. 2010/0056297; Golf Club Head with Moveable Insert, U.S. Pub. 2010/0105499; Golf Club Head, U.S. Pat. No. 7,803,065; Metal Wood Golf Club Head, U.S. Pub. 2008/0227564; Golf Club Head With Multi-Component Construction, U.S. Pub. 2011/0152003; Golf Club Heads, U.S. Pub. 2011/0151989; Method of Making Golf Clubs, U.S. Pub. 2011/0277313; and Method of Making Golf Clubs, U.S. Pub. 2010/0298065, the contents of each of which are hereby incorporated by reference in their entirety. Club head 101 can have any combination of one or more rib, weight, or other structural element beneficial to playability of the club.

A club head of the invention can include additional weights or moveable (e.g., rotatable or sliding) or interchangeable weight members, for example, to optimize a center of gravity or a moment of inertia of club head 101. Any method known in the art can be used to add adjustable weight or further functionalize club head 101. Rotatable members are described in Adjustable Golf Club, U.S. Pat. No. 2,593,368; Club Head with Movable Weight, U.S. Pat. No. 3,589,731; Weight Adjusting Structure of Golf Club Head, U.S. Pub. 2009/0215551; and Golf Club Head with Moveable Insert, U.S. Pub. 2010/0105499 (see, e.g., FIGS. 22-24); and Adjustable Golf Club, U.S. Pat. No. 4,735,414, the contents of each of which are herein incorporated by reference in their entirety. Non-rotatable (e.g., sliding, interchangeable, repositionable, etc.) mechanisms are described in Adjustable Weight Golf Clubs, U.S. Pub. 2008/0020861 and Golf Club Head with Alignment System, U.S. Pub. 2011/0190070 (see, e.g., FIG. 8), the contents of which are herein incorporated by reference in their entirety. Replaceable or interchangeable weight is described in Golf Club With Peripheral Weighting, U.S. Pat. No. 6,860,818, the contents of which are incorporated by reference herein in their entirety. Weight of club head 101 can be minimized, allowing weight to be re-distributed to other areas, through the use of lightweight inserts. Weight-saving inserts are described in Golf Club With Concave Insert, U.S. Pub. 2011/0275455, the contents of which are incorporated herein by reference in their entirety.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A golf club head comprising:

a stabilizing element protruding from the sole by a height H, having a maximum length L, a maximum width W, and a setback S from a front-most point on the club face when a golf club including the club head is held at address, wherein S is between about 1.5 cm and about 3.5 cm;

L is between about 2.5 cm and about 12 cm;

W is between about 3 mm and about 20 mm; and

H is between about 0.3 mm and about 2 mm, and further wherein the club head is adjustable and can be adjusted to either of a first loft setting and a second loft setting and further wherein, in either loft setting, the golf club, that includes the club head and when at address, balances with a neutral heel-toe face angle due to the stabilizing element protruding from the sole by the height H that is between about 0.3 mm and about 2 mm.

2. The club head of claim 1, wherein H is defined as, when the club head is held at address resting on flat ground, the average distance from the ground of points on the perimeter of the stabilizing element directly fore and aft of a ground contact point.

3. The club head of claim 1, further wherein the sole is configured such that, when the club head is held at address in either of a first or second configuration such that a face of the club head has a first or second loft setting, respectively, the club head makes contact with the ground only within the stabilizing element.

4. A golf club head comprising a face, a sole, a crown, a skirt, and a hosel, wherein the sole comprises a stabilizing element protruding downward from the surrounding sole area, the stabilizing element having a length L in the heel-toe direction, a width W in the face-aft direction, and a height H in the vertical direction when the club is at address, and the surrounding sole area includes that area of the sole having the same width as the stabilizing element and extending forward and aft of the stabilizing element by a distance E, wherein the stabilizing element is set back from the foremost point on the face by a distance S, wherein H is defined as the average height from the ground to all portions of the surrounding sole area; and E is more than about 1 cm, S is between about 1.5 cm and about 3.5 cm;

L is between about 2.5 cm and about 12 cm;

W is between about 3 mm and about 20 mm; and

H is between about 0.3 mm and about 2 mm, wherein the club head is adjustable and can be adjusted to either of a first loft setting and a second loft setting and further wherein, in either loft setting, a golf club, that includes the club head and when at address, balances with a neutral heel-toe face angle due to the stabilizing element protruding from the sole by the height H that is between about 0.3 mm and about 2 mm, and wherein the stabilizing element maintains a spatial relationship between a contact point and a balance point of the club head.

5. The club head of claim 4, further configured to be connected to a shaft in a first configuration giving a first loft setting and a second configuration giving a second loft setting, wherein the first loft is between about 6° and about 9.5° and the second loft is between about 11° and about 14.5°, and further wherein when a golf club that includes the club head is held at address in the first configuration or in the second configuration, it balances with substantially the same heel-toe face angle.

6. The club head of claim 4, wherein the club head is a hybrid-type club head.

7. The club head of claim 4, wherein the club head is a driver-type club head.

* * * * *